US007547085B2

(12) United States Patent
Yagi et al.

(10) Patent No.: US 7,547,085 B2
(45) Date of Patent: Jun. 16, 2009

(54) RECORDING DEVICE AND RECORDING METHOD

(75) Inventors: Takashi Yagi, Kanagawa (JP); Tadashi Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 263 days.

(21) Appl. No.: 11/444,035

(22) Filed: May 31, 2006

(65) Prior Publication Data

US 2007/0109352 A1 May 17, 2007

(30) Foreign Application Priority Data

Nov. 14, 2005 (JP) ..... 2005-328760

(51) Int. Cl.
*B41J 29/38* (2006.01)

(52) U.S. Cl. ..... 347/16; 347/5

(58) Field of Classification Search ..... 347/19, 347/101, 104–105, 5, 12, 16, 14
See application file for complete search history.

(56) References Cited

U.S. PATENT DOCUMENTS 5,581,284 A * 12/1996 Hermanson ..... 347/43
5,957,600 A * 9/1999 Ju ..... 400/708
2005/0168553 A1* 8/2005 Ushirogouchi et al. ..... 347/100

FOREIGN PATENT DOCUMENTS

| | | |
|---|---|---|
| JP | 10-181004 | 7/1998 |
| JP | 2001-199074 | 7/2001 |
| JP | 2003-266710 | 9/2003 |

* cited by examiner

*Primary Examiner*—Lamson D Nguyen
(74) *Attorney, Agent, or Firm*—Fildes & Outland, P.C.

(57) ABSTRACT

A recording device has a recording section which records an image on a recording medium which is conveyed. A recording region of the recording section is greater than or equal to a width of a recording medium of a maximum width which can be recorded. When recording a recording medium of a width which is narrower than the maximum width which can be recorded, relative positions of the recording section and the recording medium can be changed in a direction orthogonal to a conveying direction of the recording medium. The relative positions may be changed by changing a position of the recording medium in the direction orthogonal to the conveying direction.

12 Claims, 24 Drawing Sheets

RECORDING DEVICE AND RECORDING METHOD

CROSS-REFERENCE TO RELATED APPLICATION

This application claims priority under 35 USC 119 from Japanese Patent Application No. 2005-328760, the disclosure of which is incorporated by reference herein.

BACKGROUND

1. Technical Field

The present invention relates to a recording device which carries out recording on a recording medium, and to a recording method.

2. Related Art

There is known a so-called PWA (Partial Width Array) inkjet recording device which reciprocatingly scans an inkjet recording head in a main scanning direction while ejecting ink droplets from nozzles, so as to record an image on a recording sheet.

A so-called FWA (Full Width Array) inkjet recording device has been proposed in which a full-line (the width of the recording medium) elongated inkjet recording head, in which nozzles are disposed along substantially the same width as the transverse direction of the recording sheet, is fixed, and image formation is carried out on the recording sheet.

Further, there are structures in which plural inkjet recording units, at which the numbers of nozzles are relatively low, are connected linearly and made into an elongated structure.

SUMMARY

In view of the aforementioned, the present invention provides a recording device and recording method.

A first aspect of the present invention provides a recording device including: a recording section which records an image on a recording medium which is conveyed, wherein a recording region of the recording section is greater than or equal to a width of a recording medium which is a maximum width which can be recorded, and when recording a recording medium of a width which is narrower than the maximum width which can be recorded, relative positions of the recording section and the recording medium are changed in a direction orthogonal to a conveying direction of the recording medium.

BRIEF DESCRIPTION OF THE DRAWINGS

Preferred embodiments of the present invention will be described in detail based on the following figures, where:

FIG. 1A is a view seen from above, and FIG. 1B is a cross-sectional view seen from the side;

FIG. 2A is a side view and FIG. 2B is a bottom view;

FIG. 12A-2 is a diagram explaining a state of recording the same image onto the recording sheet P2 at the left reference, FIG. 12B-1 is a diagram explaining a state of recording the same image onto the recording sheet P3 at a central reference, and FIG. 12B-2 is a diagram explaining a state of recording the same image onto the recording sheet P2 at the central reference;

FIG. 18A is a diagram before a first conveying section moves in a Y direction, and FIG. 18B is a diagram after the first conveying section has moved;

DETAILED DESCRIPTION

A first embodiment, in which the present invention is applied to an inkjet recording device 100, will be described first.

Figure 1A:
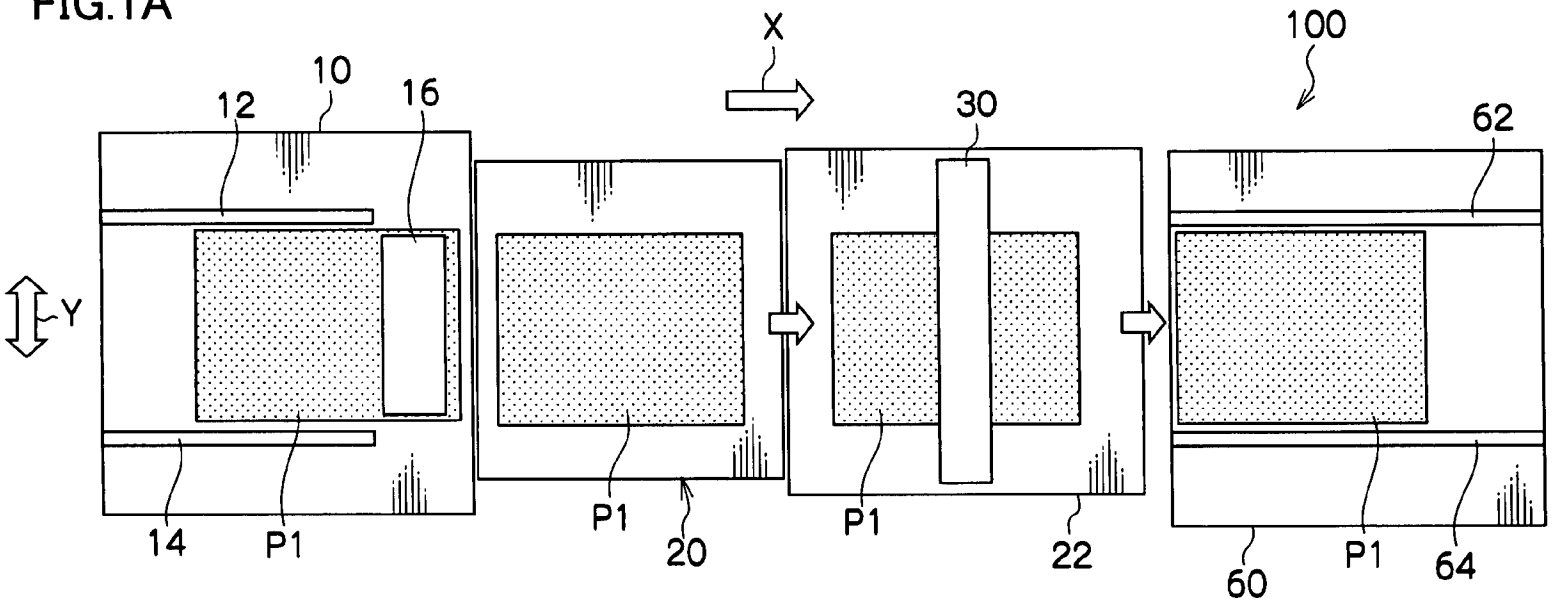
FIGS. 1A and 1B schematically show an inkjet recording device relating to a first embodiment of the present invention and show a state of recording onto a recording sheet P1 of a maximum width, where
Figure 1B:
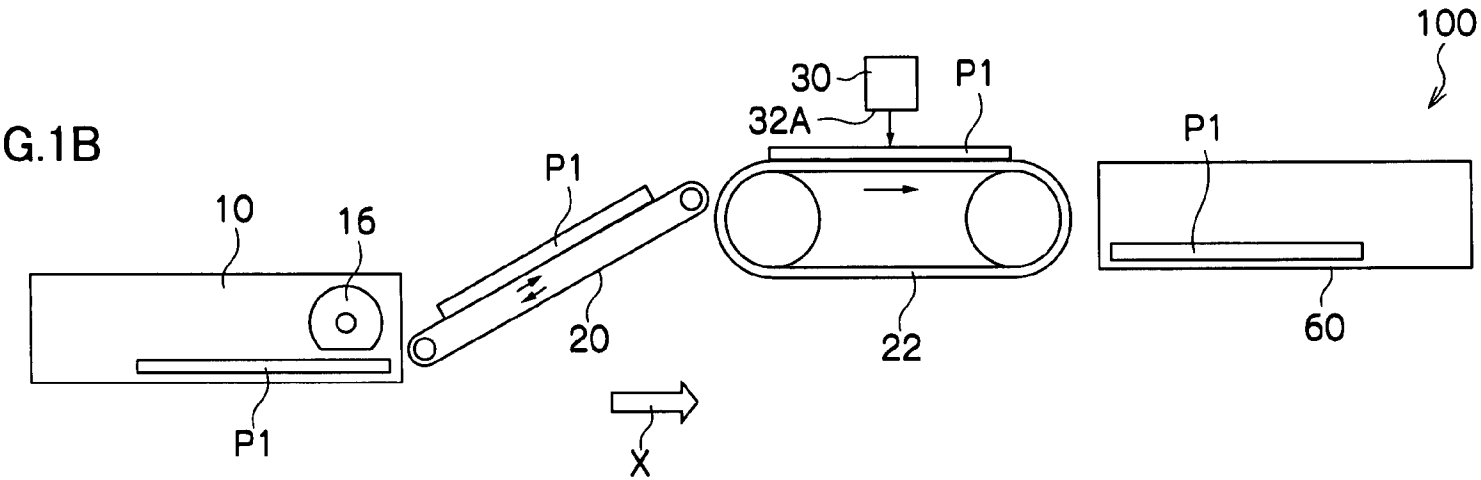

As shown in FIGS. 1A and 1B, the inkjet recording device 100 has an accommodating stocker 10 in which recording sheets are stacked and accommodated.

Note that, hereinafter, the letter P denotes a recording sheet, and the number following P expresses the size of the recording sheet. Further, the smaller the number, the larger the size, such that the order is P1>P2>P3. In cases in which there is no need to express the size, the recording sheet will simply be called "recording sheet P".

The recording sheets P of the accommodating stocker 10 are placed between accommodating guides 12, 14. The recording sheets P are fed-out one-by-one by a sheet feeding roller 16. The recording sheet P which is fed-out is conveyed by a first conveying section 20, and further conveyed by a second conveying section 22, and then discharged from the second conveying section 22 onto a sheet discharge tray 60. Sheet discharging guides 62, 64 are provided at the sheet discharge tray 60 as well, and the recording sheet P is discharged to between the sheet discharging guides 62, 64.

Above the second conveying section 22, an elongated inkjet recording head 30 is disposed in a Y direction (the sheet transverse direction) which is orthogonal to a conveying direction X of the recording sheet P.

Figure 2A:
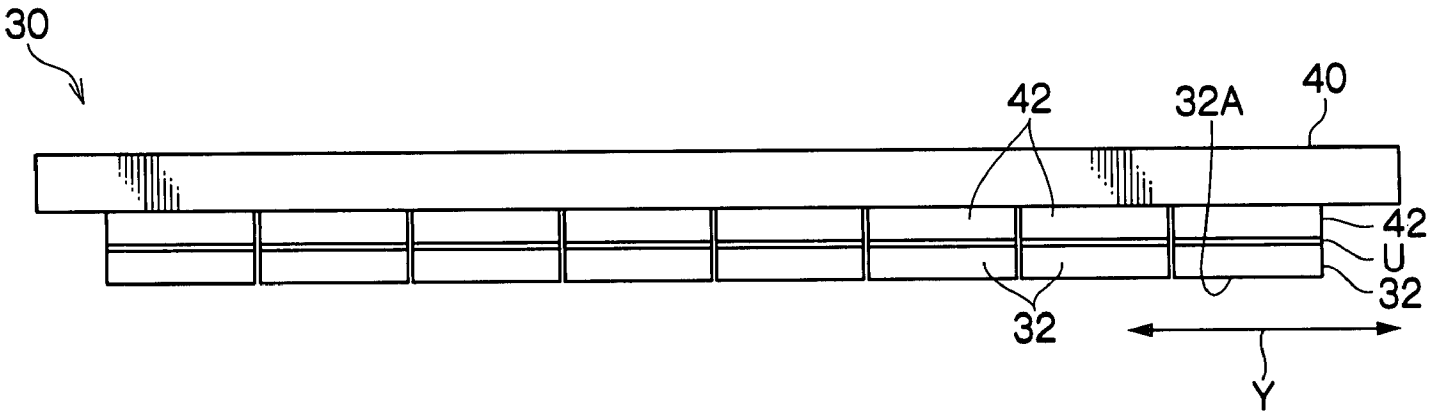
FIGS. 2A and 2B schematically show an inkjet recording head, where
Figure 2B:
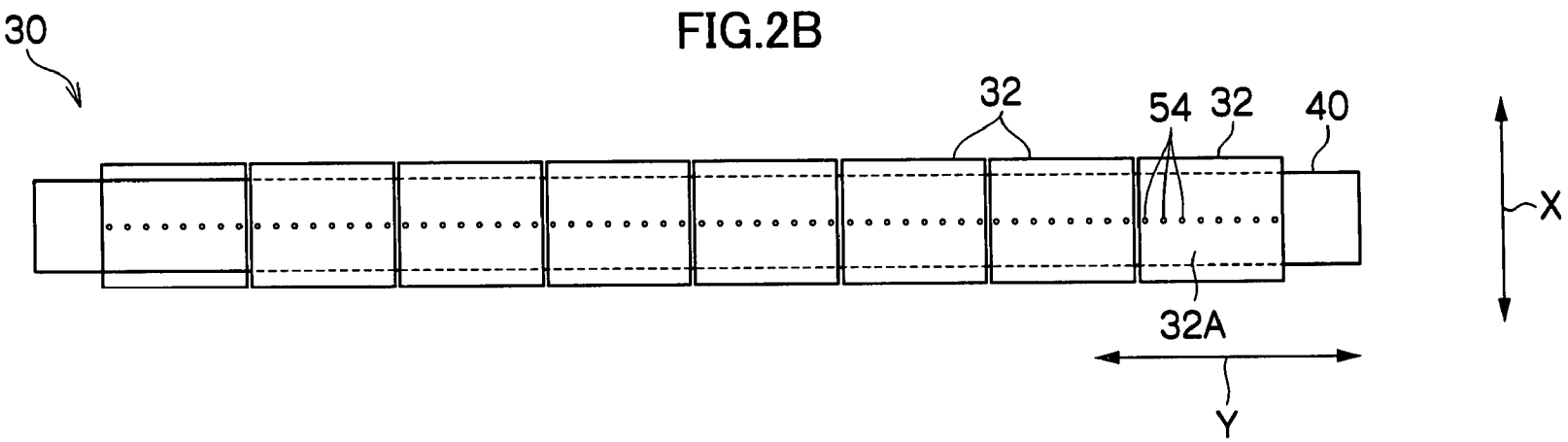

As shown in FIGS. 2A and 2B, plural recording head units 32 are disposed at the inkjet recording head 30 so as to be lined up in the Y direction (the sheet transverse direction) which is orthogonal to the conveying direction X. As shown in FIG. 2B, plural nozzles 54 are formed in a line in the sheet transverse direction Y in the recording head units 32. Further, as shown in FIGS. 1A and 1B, an image is recorded onto the recording sheet P due to ink droplets being ejected from the nozzles 54 (see FIG. 2B) onto the recording sheet which is conveyed through the second conveying section 22. Note that, although only one inkjet recording head 30 is illustrated, at least four of the inkjet recording heads are disposed in correspondence with the respective colors of YMCK, in order to record a so-called full-color image.

Figure 3:
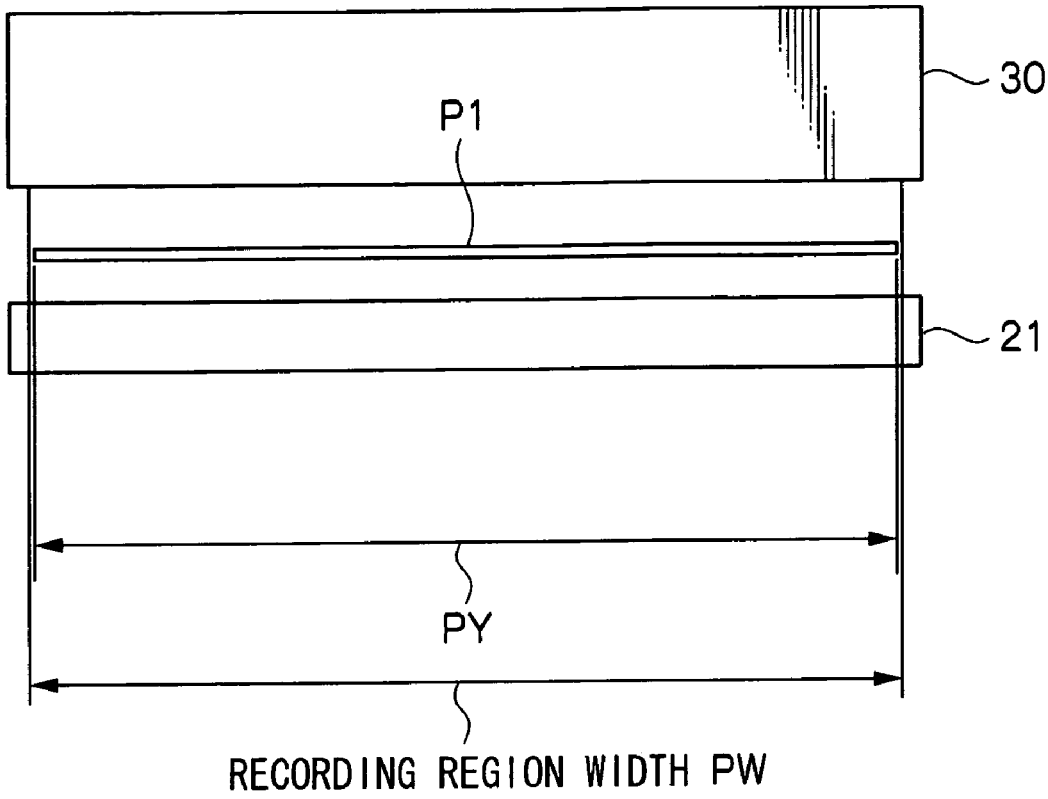
FIG. 3 is a diagram explaining a recording region of the inkjet recording head.

As shown in FIG. 3, a recording region width PW by the nozzles 54 (see FIG. 2B) of the inkjet recording head 30 is made to be longer than a sheet maximum width PY of the recording sheet P1 of the maximum size for which image recording at the inkjet recording device 100 is supposed. Image recording over the entire width of the recording sheet P1 of the maximum size is possible without moving the inkjet recording head 30 in the sheet transverse direction Y (so-called Full Width Array (FWA)). Here, the basis for the recording region width PW is the largest recording region among recording regions which are obtained by subtracting margins, at which printing is not carried out, from the both ends of sheets. The recording region width PW is generally made to be larger than the maximum width PY of sheets which are objects of printing. This is because there is the concern that the recording sheet will be conveyed at an incline of a predetermined angle with respect to the conveying direction (i.e., will be skewed), and also because there is a high demand for borderless printing.

Details of the inkjet recording head 30 will be described next.

Figure 4:
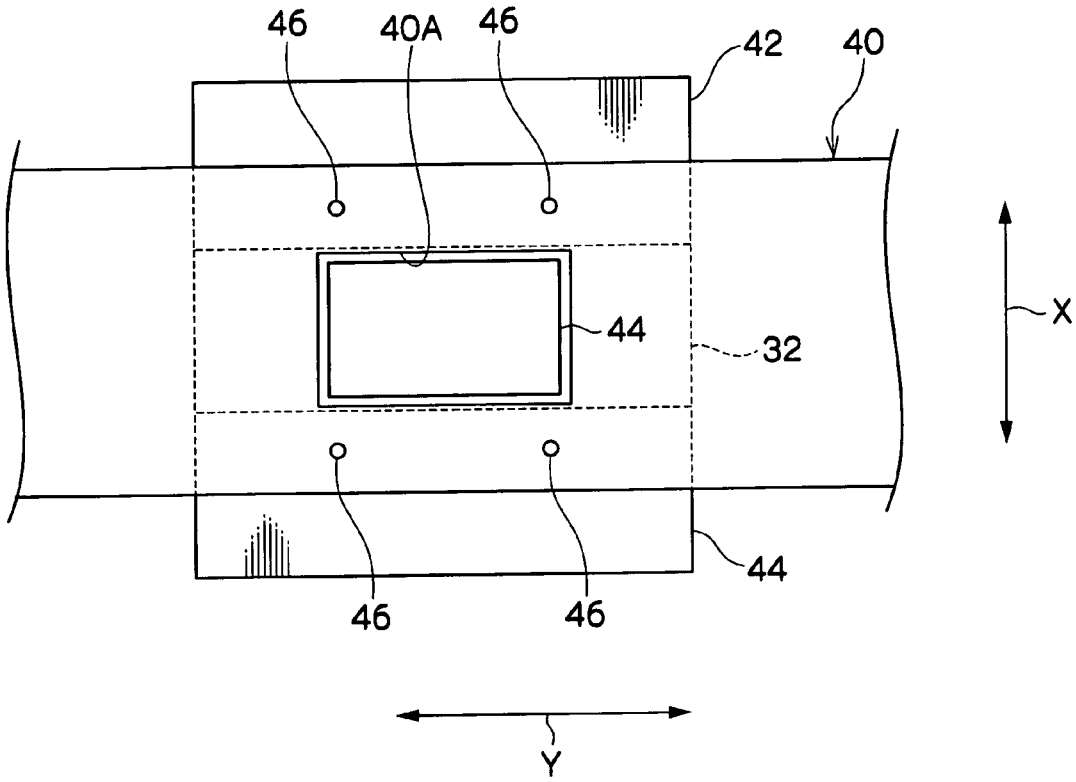
FIG. 4 is a diagram showing the structure of a mounting portion of spacer members of the inkjet recording head.

As shown in FIGS. 2A, 2B and 4, the inkjet recording head 30 is structured so as to include an elongated substrate 40, the plural recording head units 32, and plural spacer members 42. The elongated substrate 40 is long along the sheet transverse direction Y, and plural opening portions 40A (see FIG. 4) are formed therein.

The spacer members 42 are mounted to the bottom surface of the elongated substrate 40. The spacer members 42 are plate-shaped. For each of the recording head units 32, two of the spacer members 42 are disposed so as to be separated from one another along the conveying direction X, as shown in FIG. 4. The spacer members 42 are screwed to the elongated substrate 40 by screws 46 at two places. In this way, the spacer members 42 can be attached to and removed from the elongated substrate 40. An ink supplying unit 44 (see FIG. 4), which supplies ink from an ink tank (not shown) to the recording head unit 32, is disposed between the two spacer members 42. By placing the two spacer members 42 so as to be separated from one another in this way, there is no need to provide flow paths for supplying ink at the spacer members 42 themselves, the ink supplying units 44 can be disposed in these regions of separation, and ink supply paths can be ensured. Further, there is no need to form ink supply paths in the spacer members 42, it is possible to select the material of the spacer members 42 without taking ink-resistance into consideration, and degrees of freedom in selecting the material used for the spacer members 42 are obtained.

As shown in FIG. 2B and as described above, the nozzles 54 which eject the ink are formed in a single row in the sheet transverse direction Y in a nozzle surface 32A of the recording head unit 32. A piezoelectric element, a vibrating plate, a pressure chamber, and the like for ejecting the ink are provided at the interior of the recording head unit 32.

The recording head units 32 are disposed at the side opposite the elongated substrate 40, with the spacer members 42 sandwiched therebetween. As seen from the side of the nozzle surfaces 32A, the end side portions of the spacer members 42 and the recording head units 32, which are at the outer sides of the elongated substrate 40 along the sheet transverse direction Y, are substantially the same configuration. The recording head units 32 are joined and fixed to the spacer members 42 at the both end side portions along the sheet transverse direction Y, i.e., the both end side portions along the longitudinal direction of the recording head units 32. The joining and fixing of the recording head units 32 to the spacer members 42 is carried out by an adhesive U (see FIG. 2A). The adhesive U is interposed at the both end side portions between the recording units 32 and the spacer members 42.

Gaps corresponding to the thickness of the adhesive U are formed between the recording head units 32 and the spacer members 42. The heights of the nozzles surfaces 52A of the plural recording head units 32 can be made to be uniform by adjusting these gaps.

Note that, in the present embodiment, description is given of an example in which an adhesive is used for the joining and fixing. However, the joining and fixing may be by welding, or by some other method.

Because the inkjet recording head 30 is structured in this way, the recording head units 32 can be separated from the elongated substrate 40 by removing the spacer members 42 from the elongated substrate 40. Namely, it is possible to carry out replacement per recording head unit 32.

Operation and the like of the inkjet recording device 100 of the present embodiment will be described next.

As shown in FIGS. 1A and 1B, when an electric signal instructing printing is sent to the inkjet recording device 100 from an external device, e.g., a personal computer or the like, the recording sheets P are picked-up one-by-one from the accommodating stocker 10, are fed by the first conveying section 20, and are further fed by the second conveying section 22.

An image based on image data is recorded onto the recording sheet P due to ink droplets being selectively ejected from the plural nozzles 54 of the recording head units 32 while the second conveying section 22 conveys the recording sheet P at a predetermined conveying speed. The recording sheet P, on which the image is recorded, is discharged out between the sheet discharging guides 62, 64 of the sheet discharge tray 60.

As shown in FIG. 3, in a case of printing the recording sheet P1 of the maximum sheet width PY at which image recording at the inkjet recording device 100 is supposed, substantially the entire region of the printing region width PW of the inkjet recording head 30 is used.

On the other hand, as shown in FIGS. 5A, 6A, 7A and 7B, in cases of printing recording sheets P2, P3 of widths which are narrower than that of the recording sheet P1, only a portion of the recording region PW of the inkjet recording head 30 is used, and the region other than this portion is not used.

Therefore, the deterioration of only the partial region which is concentratedly used advances, and the printing quality level of only this partial region falls. Because a difference in the printing quality level (the extent of deterioration) arises between this partial region and the region other than the partial region, when printing the recording sheet P1, the printing quality level is different at the partial region and the region other than the partial region, and the overall image quality deteriorates markedly.

Accordingly, the inkjet recording device 100 of the present embodiment can print both in a case in which the left side is the reference with respect to the conveying direction X of the recording sheet as shown in FIGS. 5A, 6A, 7A, and 7B, and in a case in which the right side is the reference with respect to the conveying direction X of the recording sheet P as shown in FIGS. 5B, 6B, 8A, 8B, and 9.

Figure 5B:
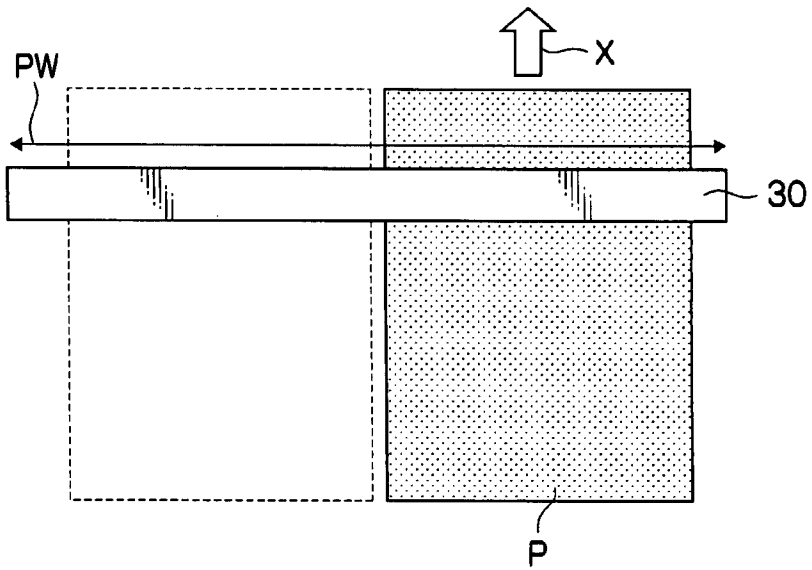
FIG. 5B is a diagram explaining a state of moving the recording sheet P2 and recording at a right reference.
Figure 5A:
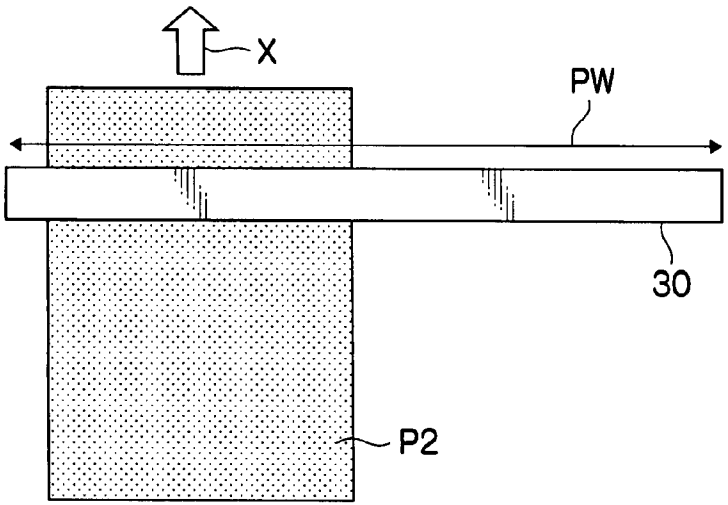
FIG. 5A is a diagram explaining a state of recording onto a recording sheet P2 of a narrow width at a left reference.
Figure 6B:
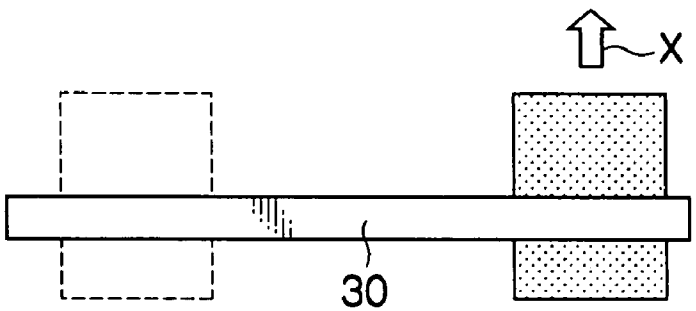
FIG. 6B is a diagram explaining a state of moving the recording sheet P3 and recording at the right reference.
Figure 6A:
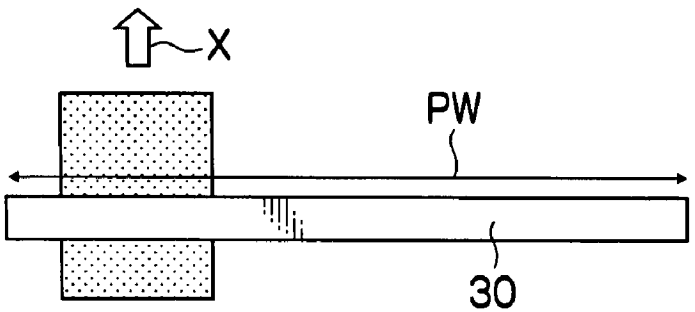
FIG. 6A is a diagram explaining a state of recording onto a recording sheet P3 of a narrow width at the left reference.
Figure 7A:
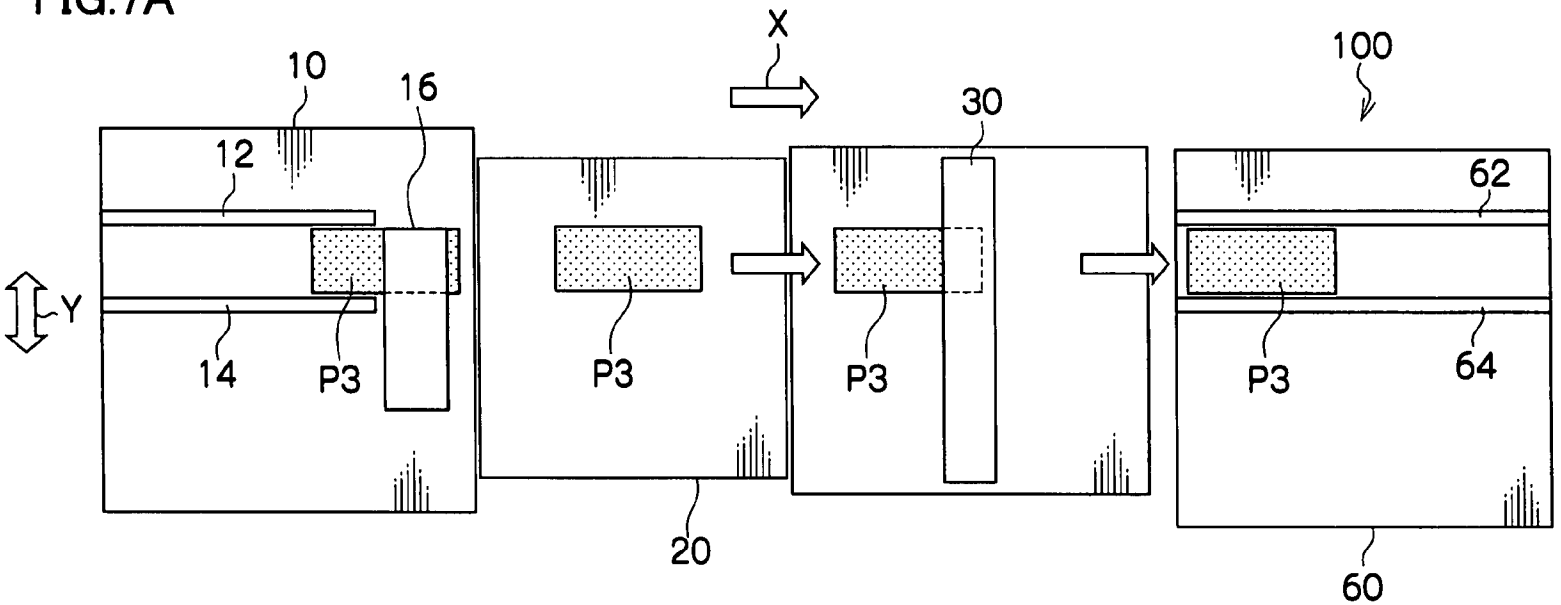
FIG. 7A is a diagram seen from above and showing a state of recording onto the recording sheet P3 of a narrow width at the left reference in FIG. 1A.
Figure 7B:
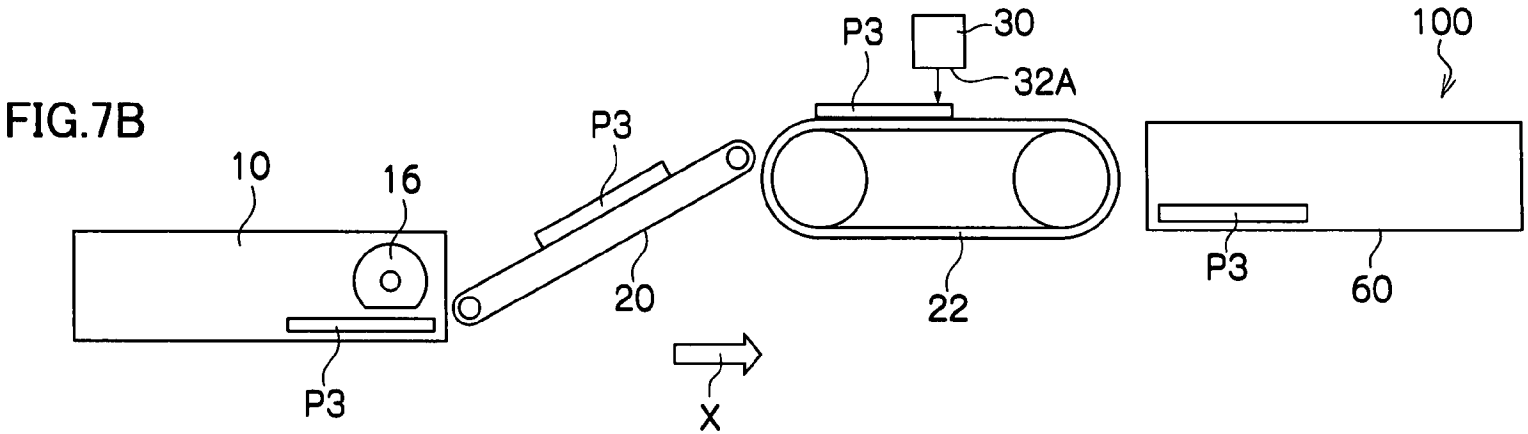
FIG. 7B is a cross-sectional view seen from the side and showing a state of recording onto the recording sheet P3 of a narrow width at the left reference in FIG. 1B.
Figure 8A:
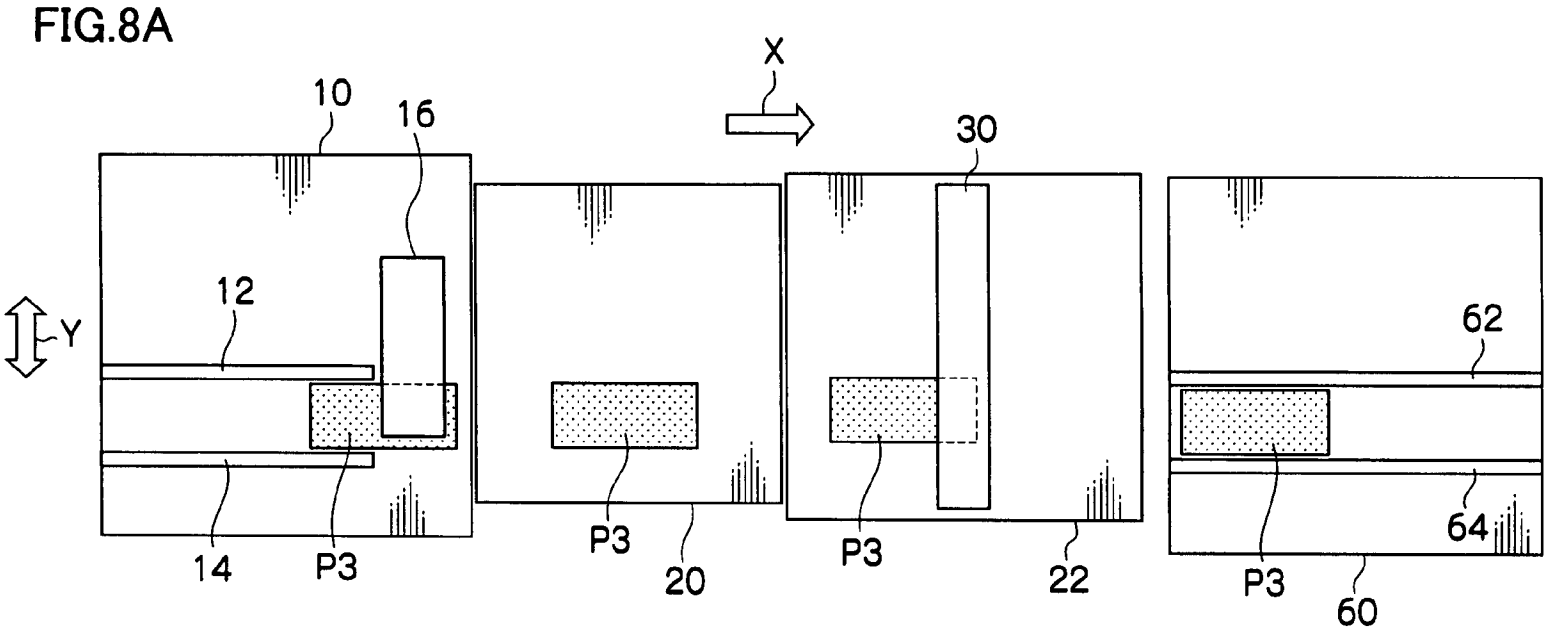
FIG. 8A is a diagram seen from above and showing a state of recording onto the recording sheet P3 of a narrow width at the right reference in FIG. 1A.
Figure 8B:
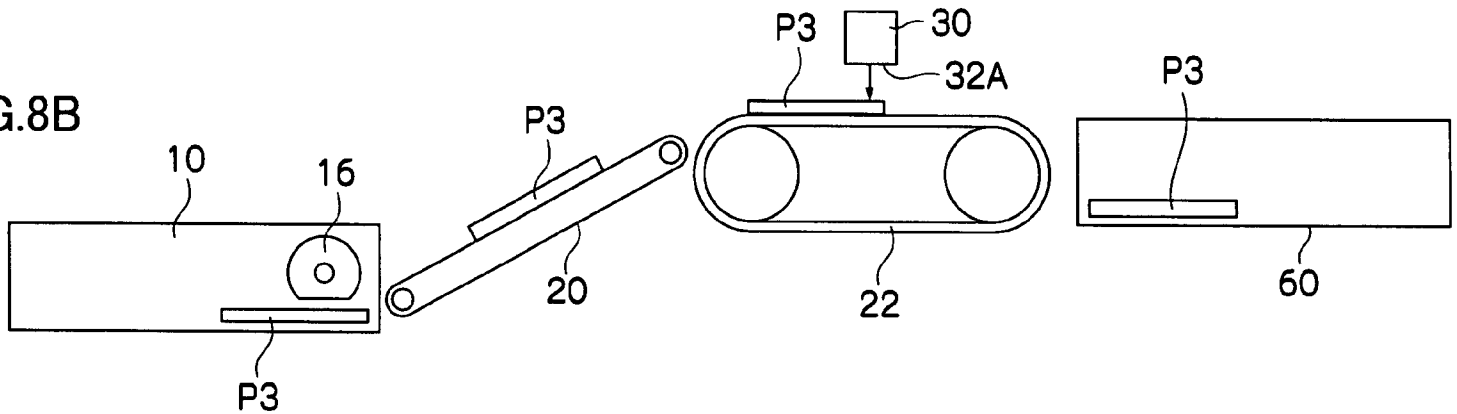
FIG. 8B is a cross-sectional view seen from the side and showing a state of recording onto the recording sheet P3 of a narrow width at the right reference in FIG. 1B.
Figure 9:
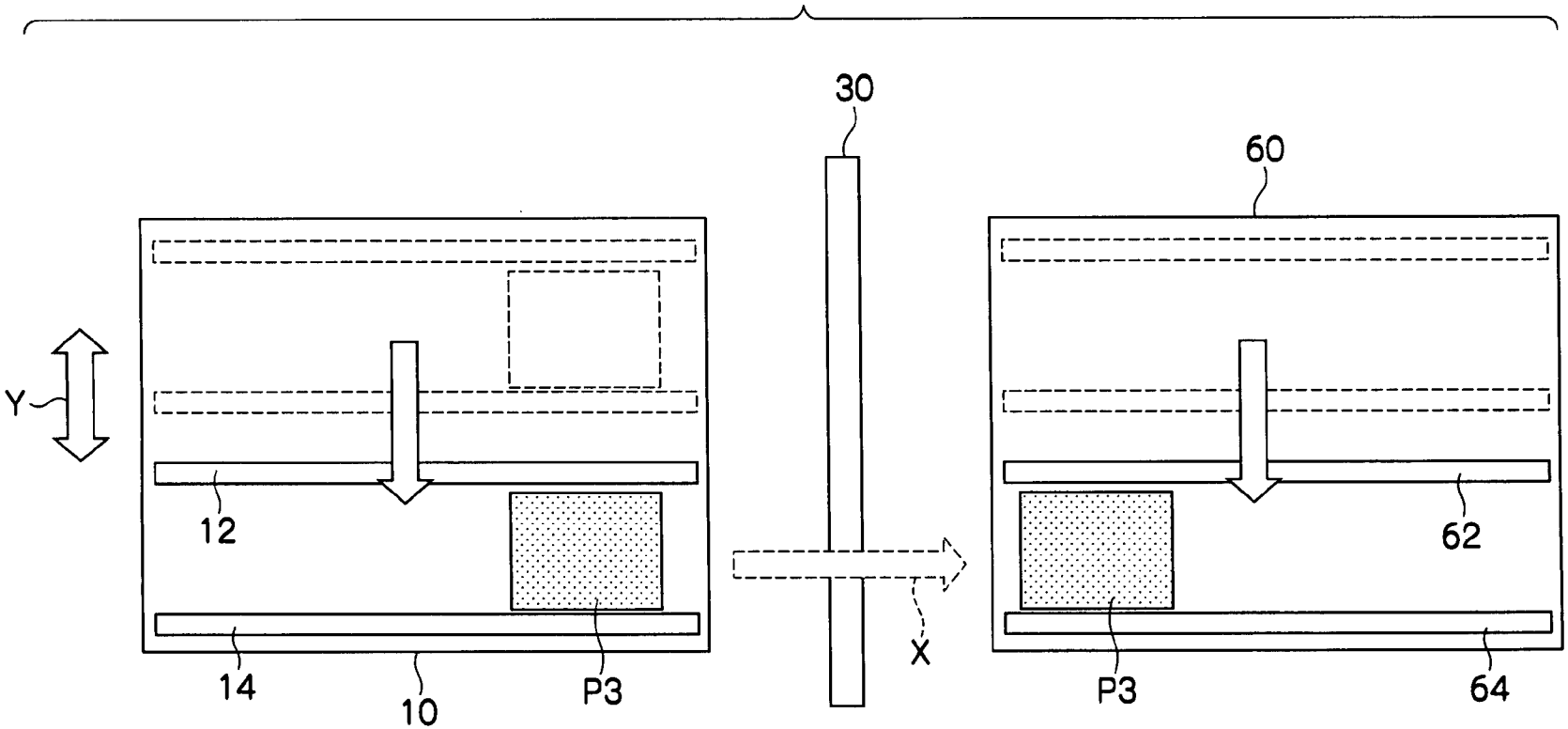
FIG. 9 is a schematic diagram explaining movement of accommodating guides of an accommodating stocker and discharging guides of a sheet discharge tray.

Specifically, as shown in FIGS. 8A, 8B and 9, by moving the accommodating guides 12, 14 of the accommodating stocker 10 in the transverse direction Y, the region which uses the inkjet recording head 30 can be changed (refer to FIGS. 5B and 6B as well). The sheet discharging guides 62, 64 of the sheet discharge tray 60 as well move in the transverse direction Y Note that, accompanying this movement, the region of the inkjet recording head 30 which ejects ink droplets also is changed automatically (the reference changes from the left reference to the right reference).

By changing the relative positions, in the transverse direction Y, of the inkjet recording head 30 and the recording sheet P in this way, it is not the case that only a partial region of the inkjet recording head 30 is used concentratedly, and a deterioration in image quality is prevented. Moreover, by using the entire region on average, the lifespan of the inkjet recording head 30 is lengthened.

Further, batch printing onto the recording sheets P can be carried out after the relative positions between the inkjet recording head 30 and the recording sheets P in the transverse direction Y have been changed. Therefore, printing can be carried out without decreasing the printing speed.

Moreover, a structure may be used in which the moving of the accommodating guides 12, 14 of the accommodating stocker 10 and the sheet discharging guides 62, 64 of the sheet discharge tray 60 are carried out manually. However, the present embodiment is structured such that they are moved automatically at a predetermined time.

The predetermined time is, for example, when recording has been carried out onto a predetermined number of the recording sheets P, when a predetermined period of time has elapsed from the start of recording, when the recorded amount recorded onto the recording sheets P has reached a predetermined recorded amount, when the same image has been recorded onto a predetermined number of sheets, at the time of start-up, or the like. Note that, in the present embodiment, the recorded amount recorded onto the recording sheets P coincides with the quantity of ink droplets which the inkjet recording head 30 ejects onto the recording sheets P. Further, the time of start-up is a case in which, when the power source of the device, which has been turned off, is turned on and the device is started-up, the members are moved to positions which are different than at the time of start-up the previous time.

More concrete description will be given hereinafter.

Figure 10B:
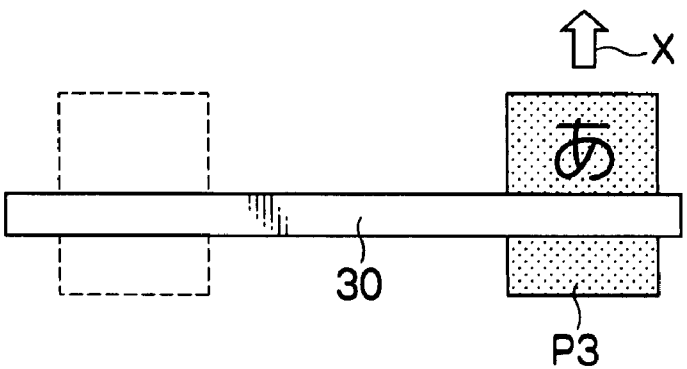
FIG. 10B is a diagram explaining a state of recording at the right reference.
Figure 10A:
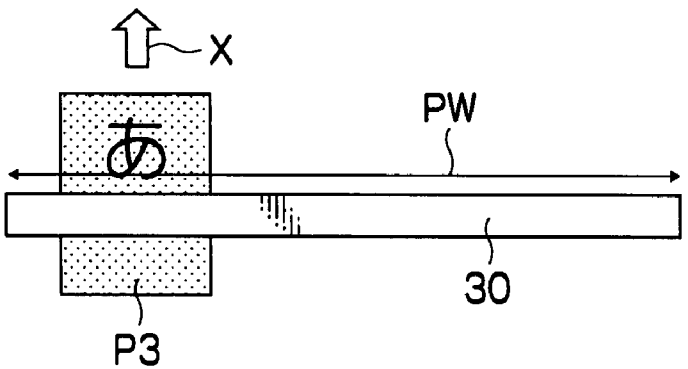
FIG. 10A is a diagram explaining a state of recording the same image onto the recording sheet P3 at the left reference.

For example, as shown in FIGS. 10A and 10B, when the same image (a Japanese character in FIGS. 10A and 10B) has been recorded onto a predetermined number of the same size recording sheets P3, the recording sheets P3 are moved. In this way, in the case of the same image, because the nozzles 54 which eject the ink droplets are specified, it is extremely effective to move the recording sheets P3 and change the nozzles 54 which eject the ink droplets in this way.

Figure 11B:
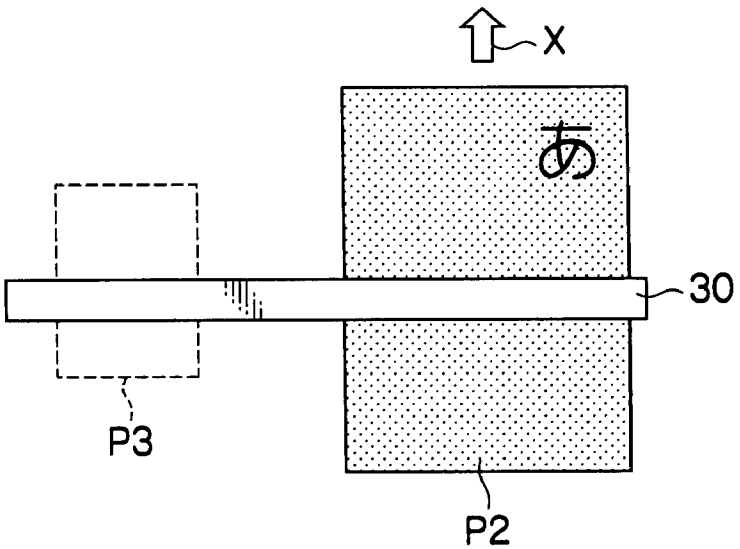
FIG. 11B is a diagram explaining a state of recording the same image onto the recording sheet P2 at the right reference.
Figure 11A:
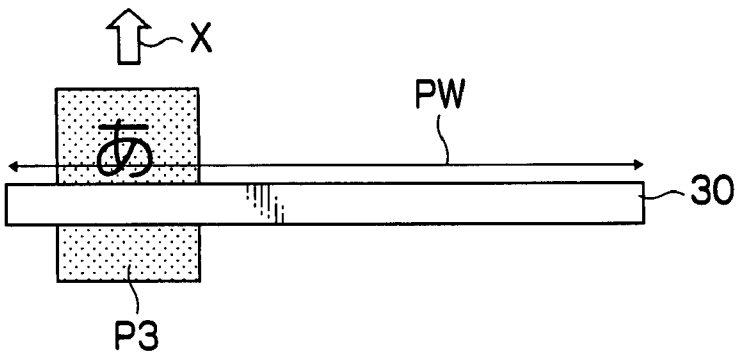
FIG. 11A is a diagram explaining a state of recording the same image onto the recording sheet P3 at the right reference.

Note that FIGS. 10A and 10B illustrate a case of recording onto the recording sheets P3 of the same size. However, as shown in FIGS. 11A and 11B, the same holds as well in cases of recording the same image onto sheets of different sizes (the recording sheets P2 and the recording sheets P3 in this case).

Figures 1, 12B:
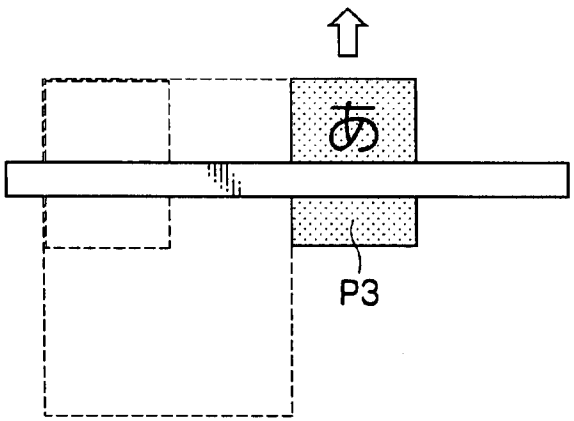
Figures 2, 12B:
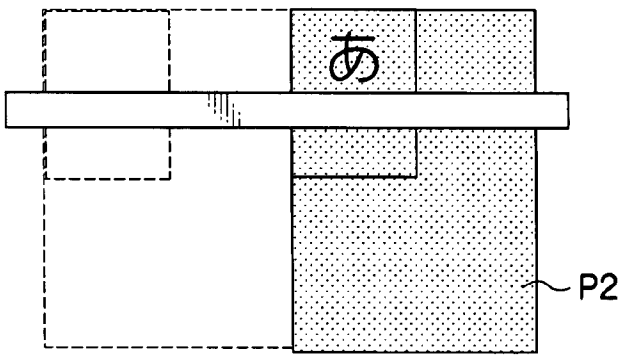
Figures 1, 12A:
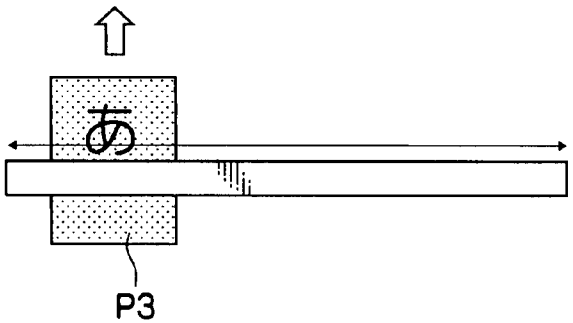
FIG. 12A-1 is a diagram explaining a state of recording the same image onto the recording sheet P3 at the left reference.
Figures 2, 12A:
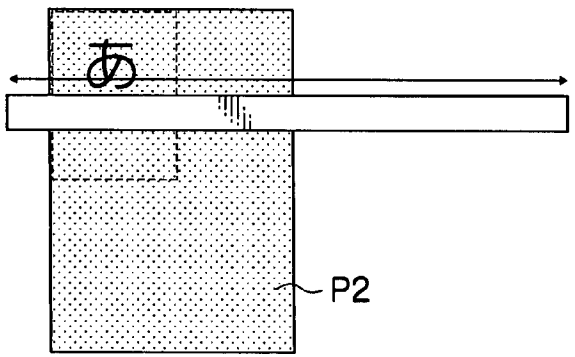
Figure 13A:
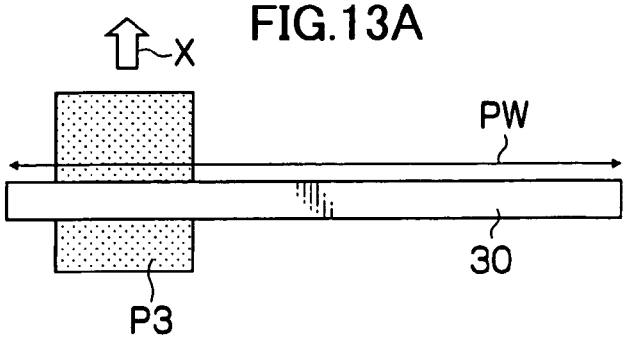
FIGS. 13A, 13B, 13C, 13D are diagrams showing in order, from A to D, states of moving the recording sheet P3 by the width of the sheet each time.
Figure 13B:
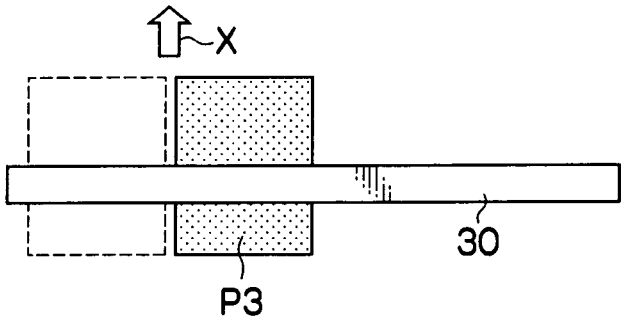
Figure 13C:
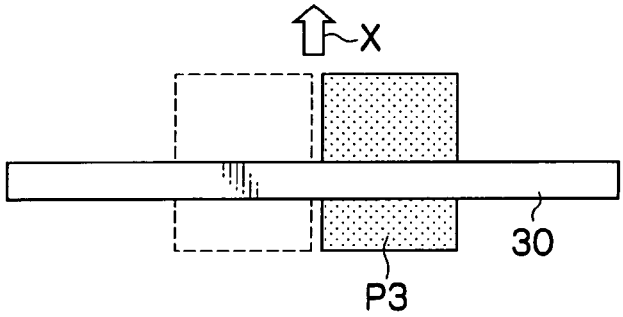
Figure 13D:
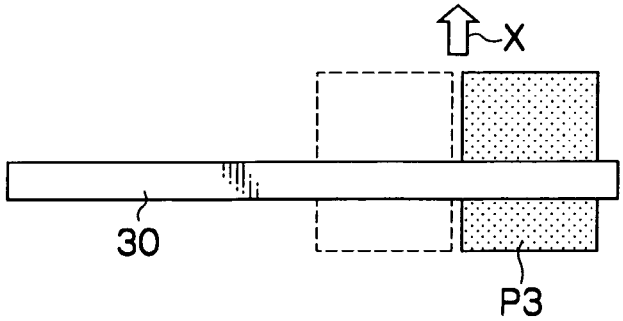

The case of different sizes may be a case of recording the recording sheets P2 and the recording sheets P3 randomly as shown in FIGS. 12A-1 and 12A-2, or may be structured such that, when the same image is recorded onto a predetermined number of sheets, the recording sheets P2 and the recording sheets P3 are moved, as shown in FIGS. 12B-1 and 12B-2.

Note that FIG. 12B-1 is an example in which the reference is a central reference, and not the right reference.

There are not only cases of moving between the left reference and the right reference, but also, it is possible to move between the left reference and the central reference as described above and as shown in FIG. 12B-1. Or, a structure may be employed in which the members are moved to one of three positions which are the left reference, the central reference, and the right reference.

Moreover, a structure may be employed in which the recording sheets P3 are moved while being shifted in order by a width corresponding to the width of the recording sheet P each time, as shown in order from FIGS. 13A to 13D. Note that, after FIG. 13D, the members return to the state shown in FIG. 13A. Or, the states from FIG. 13A to FIG. 13D may be selected randomly.

Figure 14A:
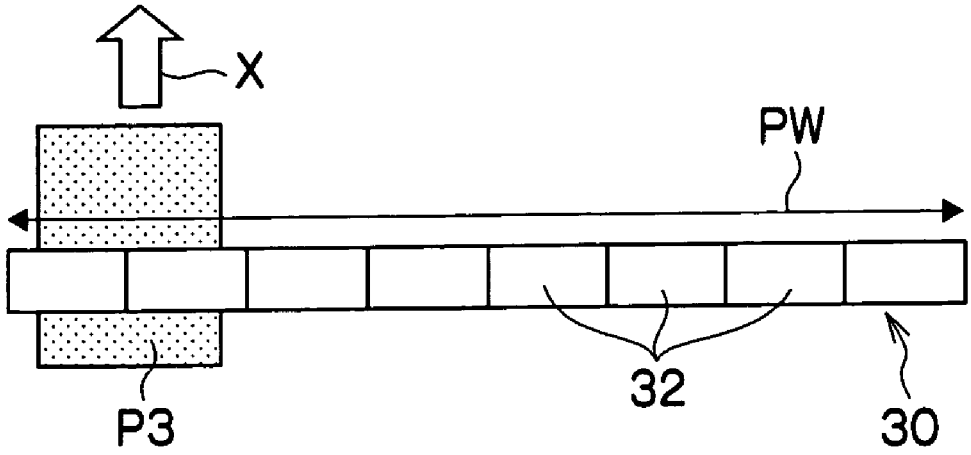
FIGS. 14A, 14B, 14C are diagrams showing in order, from A to C, states of moving the recording sheet P3 by the width of a recording unit each time.
Figure 14B:
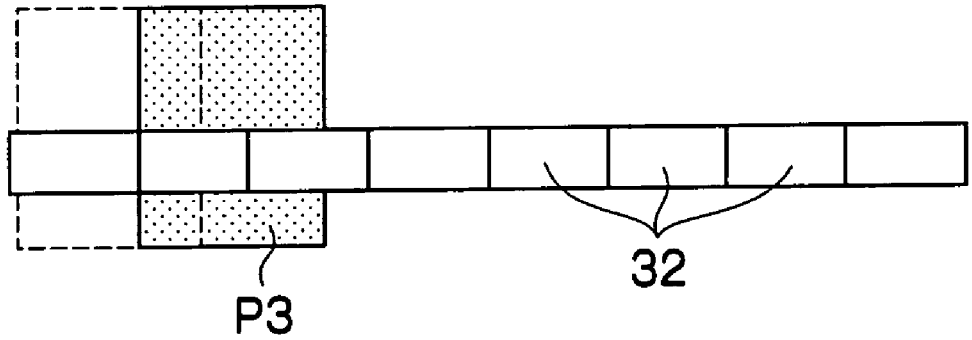
Figure 14C:
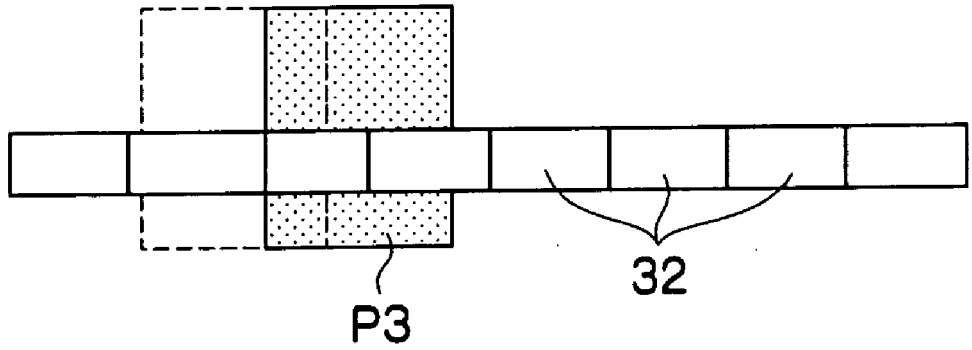
Figure 15A:
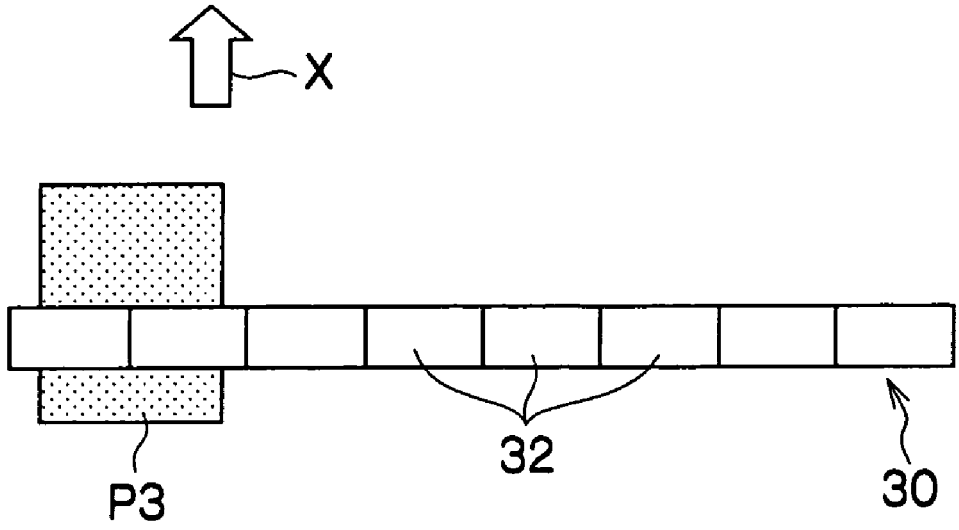
FIGS. 15A, 15B are diagrams showing states of moving the recording sheet P3 by the twice the width of the recording unit each time.
Figure 15B:
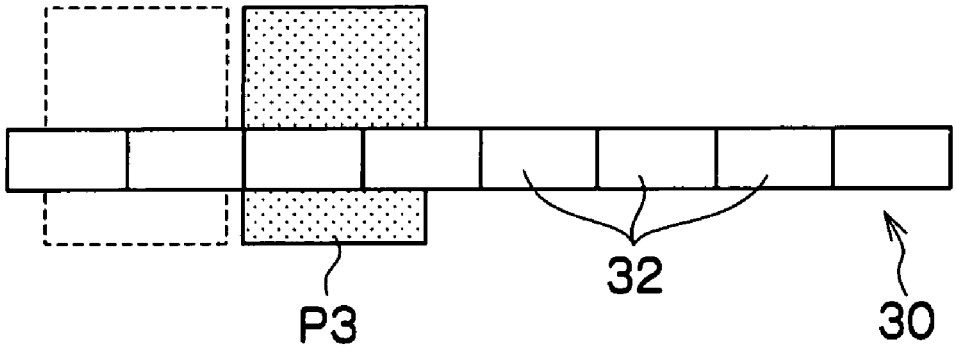

Further, a structure may be employed in which the recording sheets P3 are moved in units of the recording head unit 32, as shown in order from FIG. 14A to FIG. 14C. Or, as shown in FIGS. 15A and 15B, the recording sheets P3 may be moved by an amount corresponding to two of the recording head units 32 each time, while taking the widths of the recording head unit 32 and the recording sheet P into consideration.

Further, although not shown, a structure may be used in which the accommodating stockers 10 are provided in plural levels vertically, and the accommodating guides 12, 14 are at respectively different positions, and the recording sheets P2, P3 are disposed thereat. For example, the accommodating stockers 10 of FIGS. 7A and 7B and FIGS. 8A and 8B may be superposed vertically.

Figure 16:
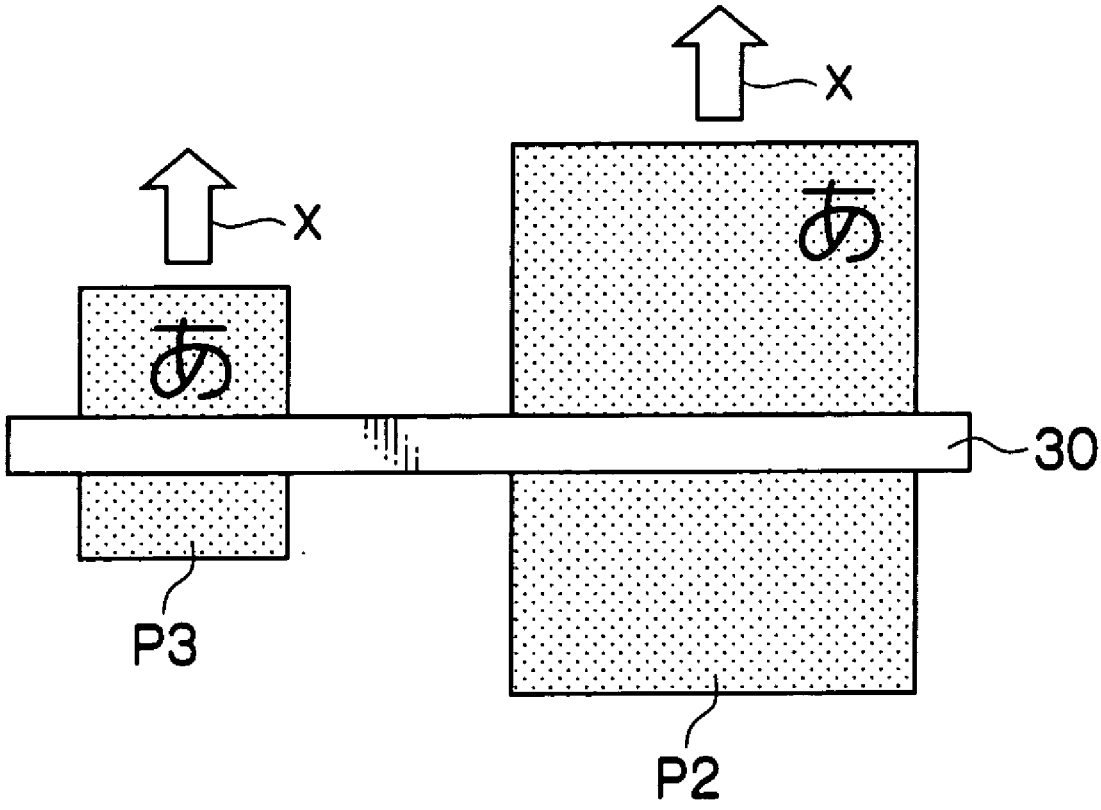
FIG. 16 is a diagram explaining a state of conveying the recording sheet P2 and the recording sheet P3 simultaneously at the left reference and the right reference, and recording onto the both.
Figure 17:
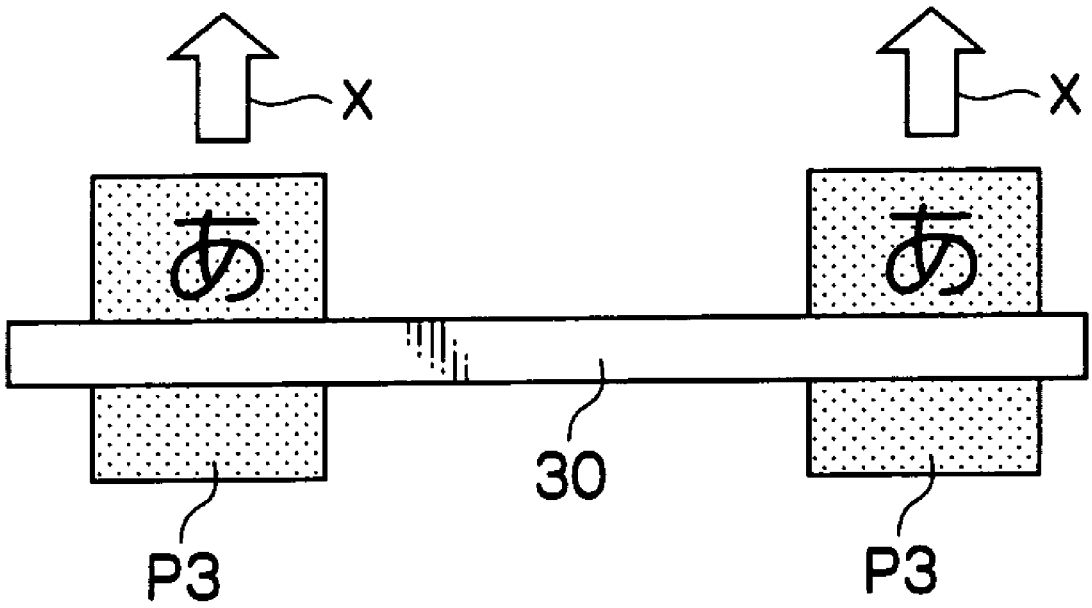
FIG. 17 is a diagram explaining a state of conveying two of the recording sheets P3 simultaneously at the left reference and the right reference, and recording onto the both.

Moreover, as shown in FIGS. 16 and 17, two of the recording sheets P2, P3 may be conveyed simultaneously in parallel, and recording carried out simultaneously thereon. In this case, it is good to use a structure in which plural accommodating stockers 10 are superposed as mentioned above.

Note that the moving of the recording sheets P may be realized by a method other than moving the accommodating guides 12, 14 of the accommodating stocker 10 as described above.

Figure 18A:
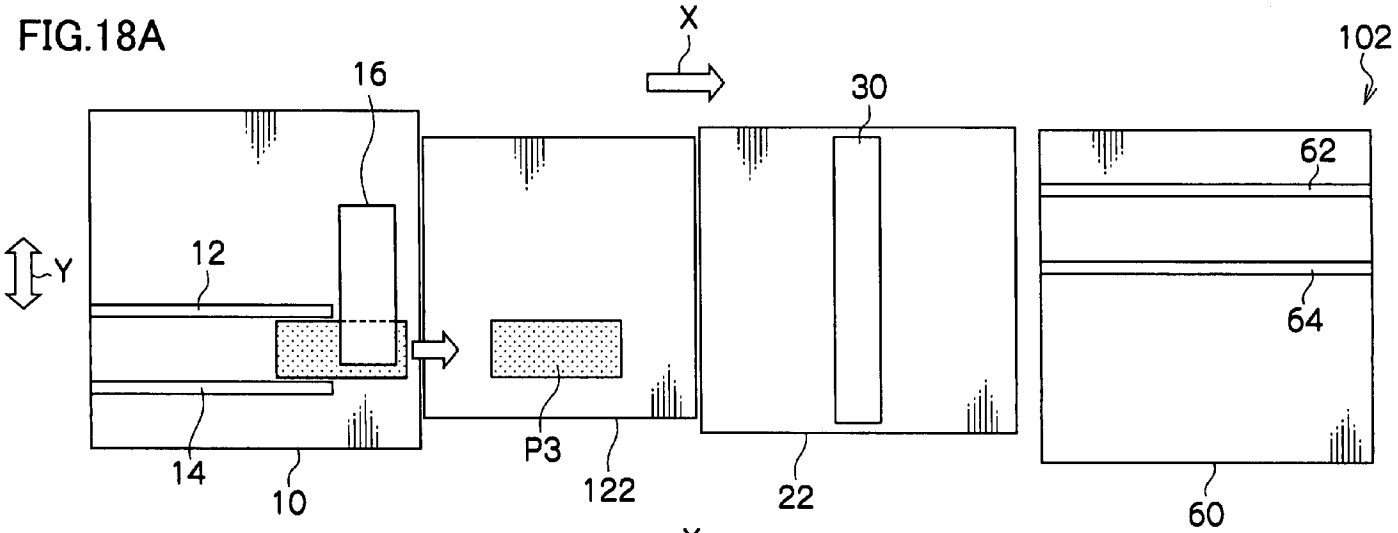
FIGS. 18A, 18B are diagrams showing, from above, an inkjet recording device relating to a modified example of the first embodiment of the present invention, where
Figure 18B:
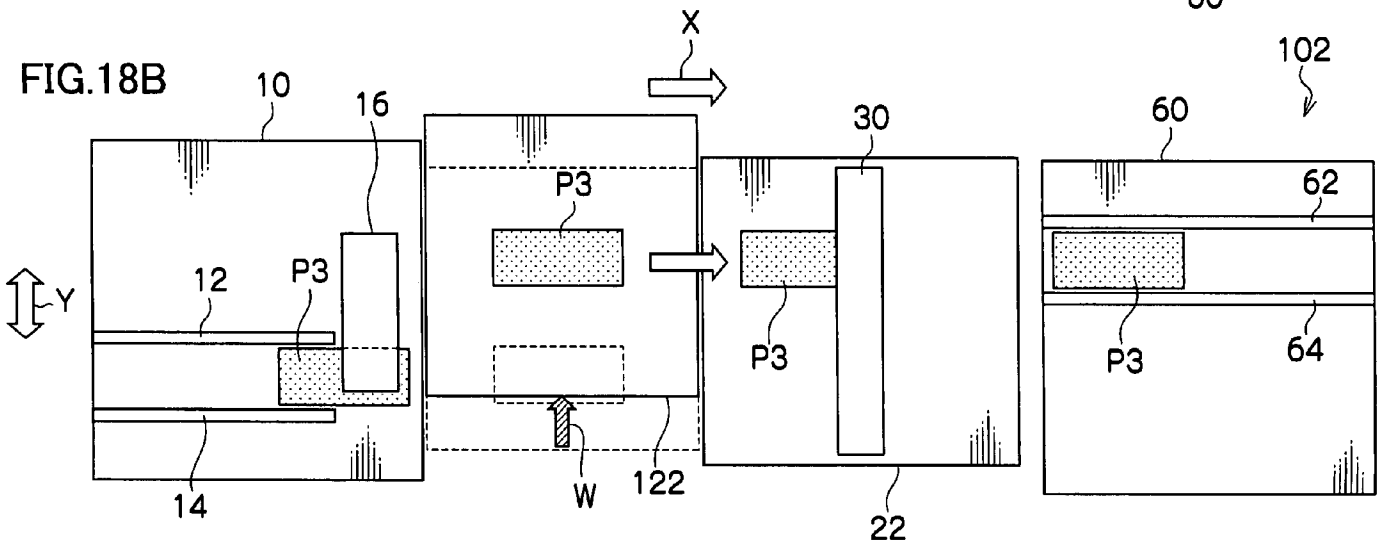

For example, as shown in FIGS. 18A and 18B, a structure may be used in which, after conveying the recording sheet P by a second conveying section 122, the entire second conveying section 122 is moved in the Y direction, as shown by arrow W. Note that the above-described accommodating guides 12, 14 of the accommodating stocker 10 and the second conveying section 122 are an example of a converting mechanism which moves the recording sheets P.

Figure 19:
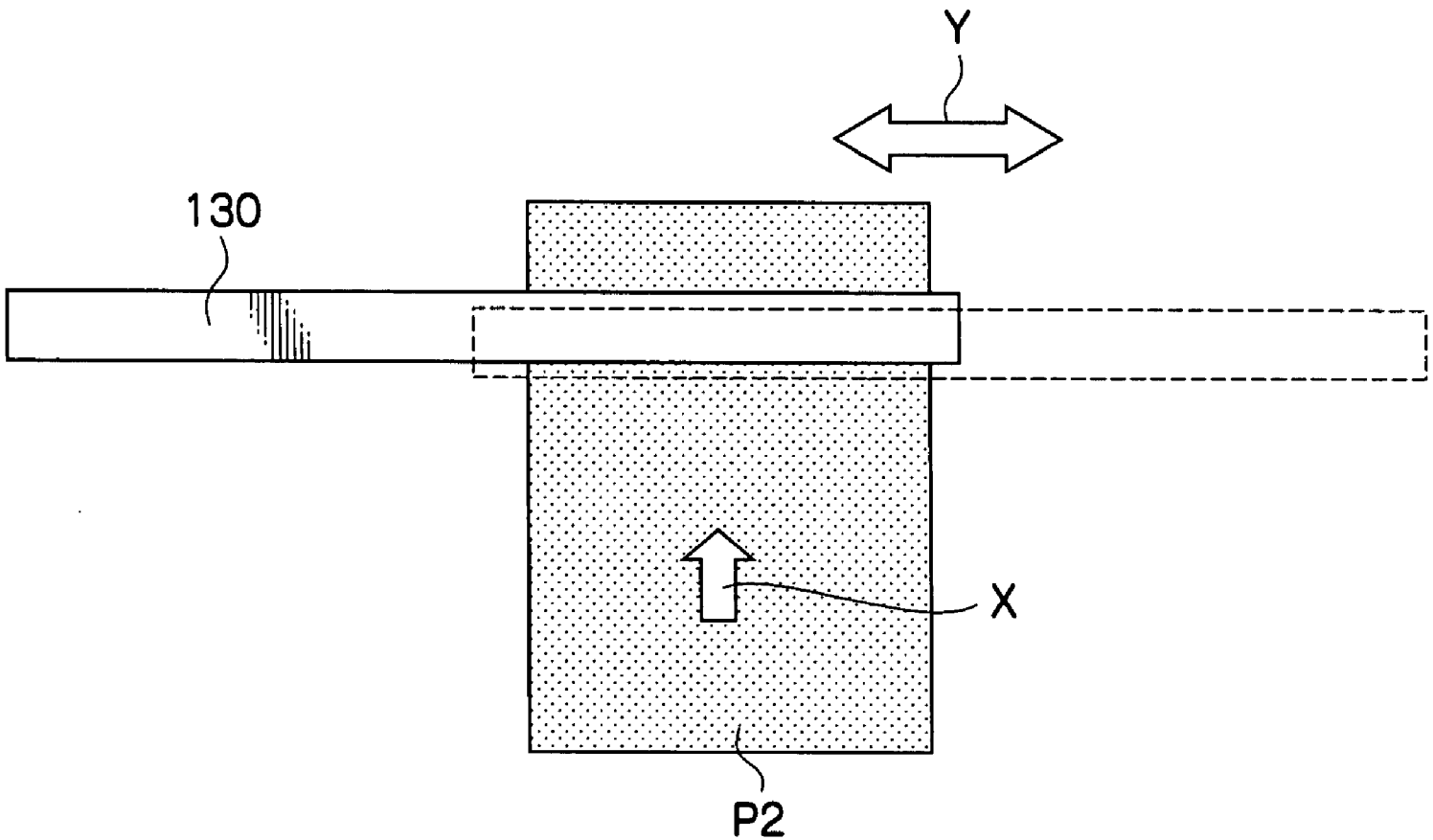
FIG. 19 is a diagram explaining a state of moving an inkjet recording head in the Y direction, and changing relative positions, in the Y direction, between a recording sheet and the inkjet recording head.

Moreover, as shown in FIG. 19, the inkjet recording head 30 may be structured so as to move in the Y direction which is orthogonal to the conveying direction X, and the relative positions between the inkjet recording head 30 and the recording sheets P in the Y direction changed. Further, a structure may be employed in which both the recording sheets P and the inkjet recording head 30 are moved in the Y direction.

A second embodiment, in which the present invention is applied to a dot impact recording device 200, will be described next.

Figure 20:
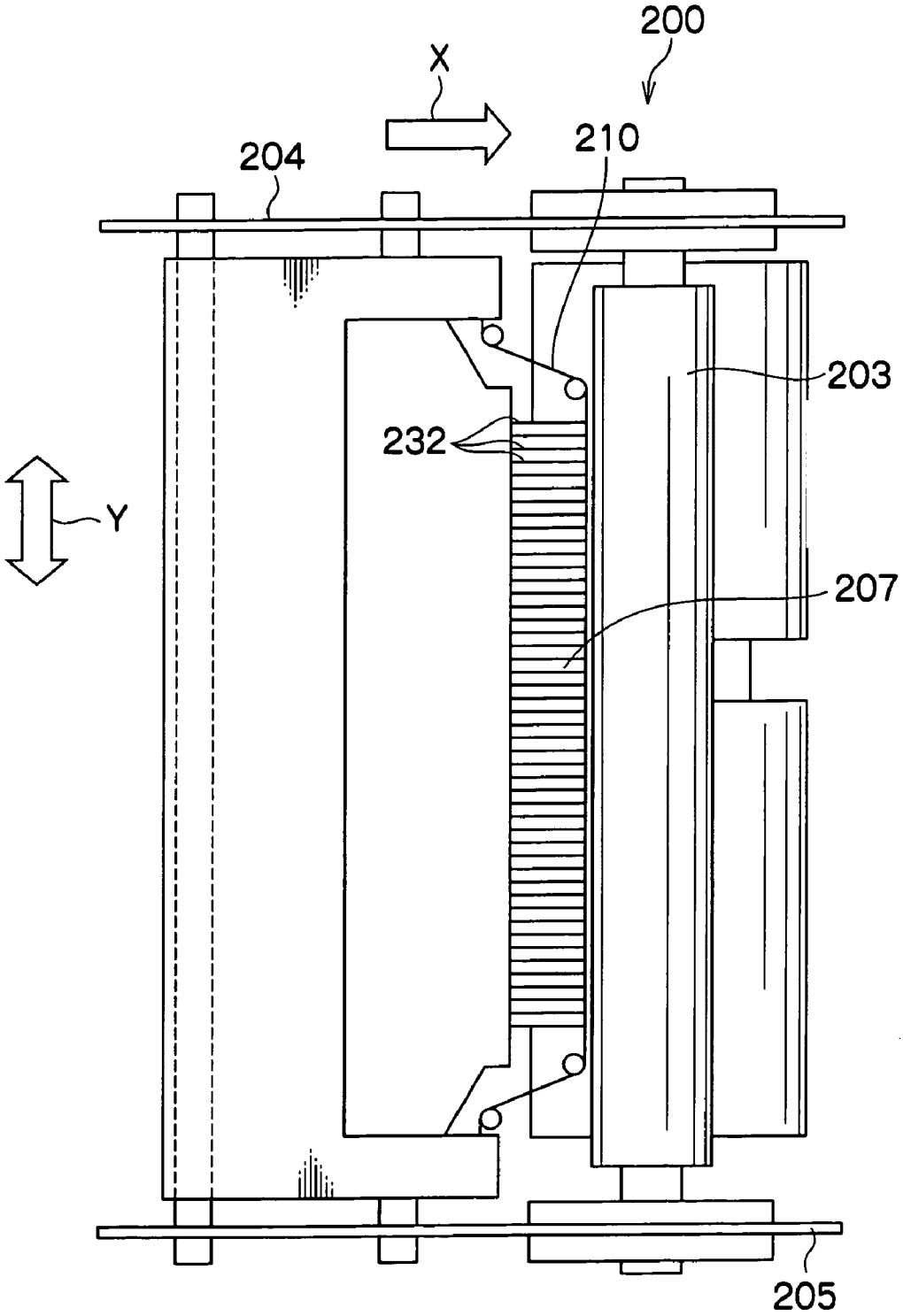
FIG. 20 is a top view schematically showing a dot impact recording device relating to a second embodiment of the present invention.

As shown in FIG. 20, the dot impact recording device 200 has a platen 203. The left and right both side portions of the platen 203 are supported by side frames 204, 205. An elongated dot impact recording head 207, which is longer than the recording sheet P1, is disposed in the Y direction which is orthogonal to the conveying direction. Plural recording units 232 are lined-up in the Y direction at the dot impact recording head 207.

Figure 21:
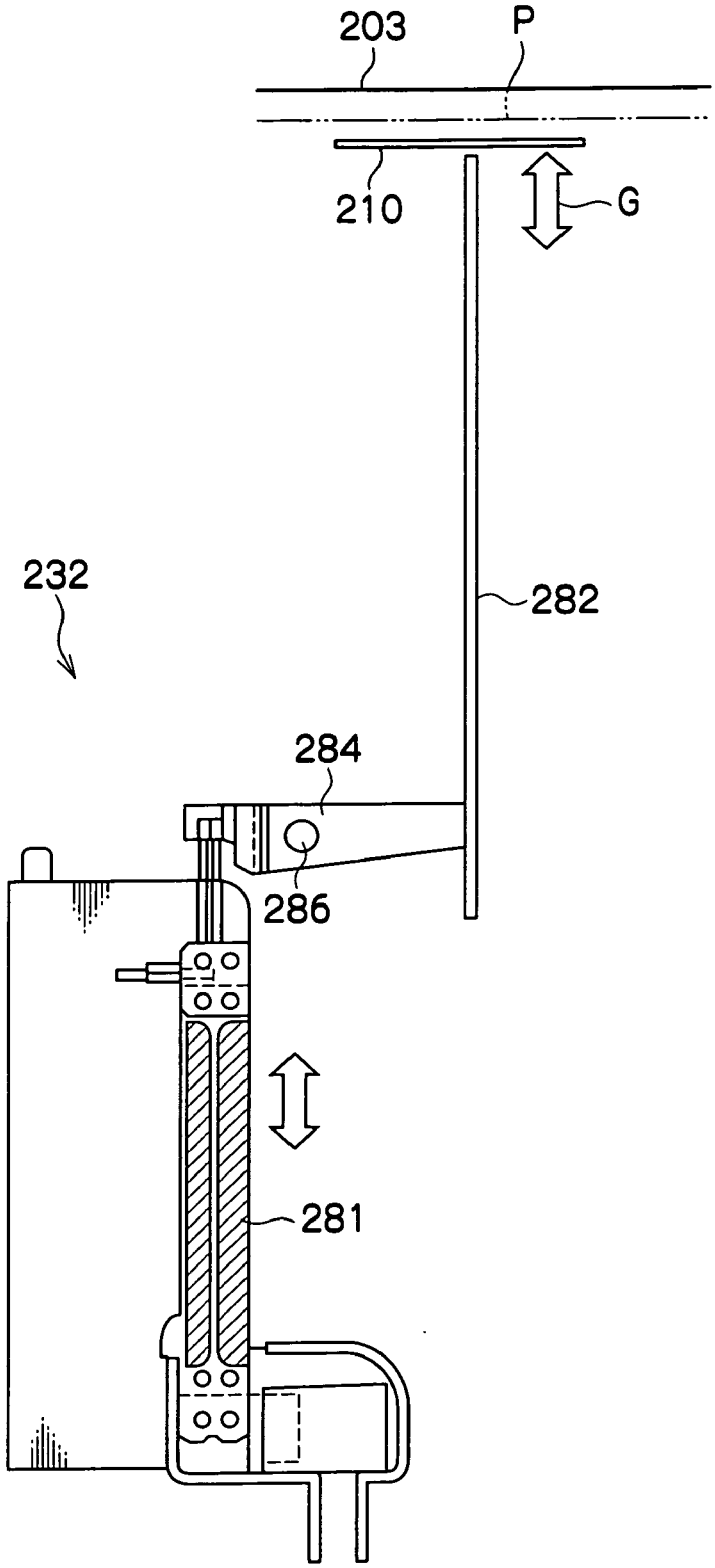
FIG. 21 is a diagram schematically showing a recording unit of the dot impact recording device relating to the second embodiment of the present invention.

As shown in FIG. 21, the recording unit 232 has a piezo element 281. Due to the extension and contraction of the piezo element 281, an arm 284 turns around a fulcrum 286, and the distal end of a wire 282 is driven to project as shown by arrow G. An ink ribbon 210 is hit by the distal end of the wire 282, and printing is carried out on the recording sheet P which is between the platen 203 and the ink ribbon 210.

Although not illustrated, the accommodating stocker described in the first embodiment is provided at the upstream side in FIG. 20, and the sheet discharge tray is provided at the downstream side.

At the dot impact recording device 200 as well, when only a partial region of the dot impact recording head 207 is used concentratedly, only the piezo elements 281 and the wires 282 of the recording units 232 of that portion deteriorate. Accordingly, in the same way as in the first embodiment, the relative positions between the recording sheets P and the dot impact recording head 207 are changed so that use does not concentrate at only the recording units 232 of only a partial region. Detailed description of changing the relative positions will be omitted as it would be redundant with that of the first embodiment.

In the recording units 232 of the above-described embodiment, the piezo elements 281 are used as the means for driving and projecting the wires, but the recording units 232 may be structured such that the wires are driven and projected by coils using electromagnets.

Next, a third embodiment, in which the present invention is applied to an electrophotographic recording device 300, will be described.

Figure 22:
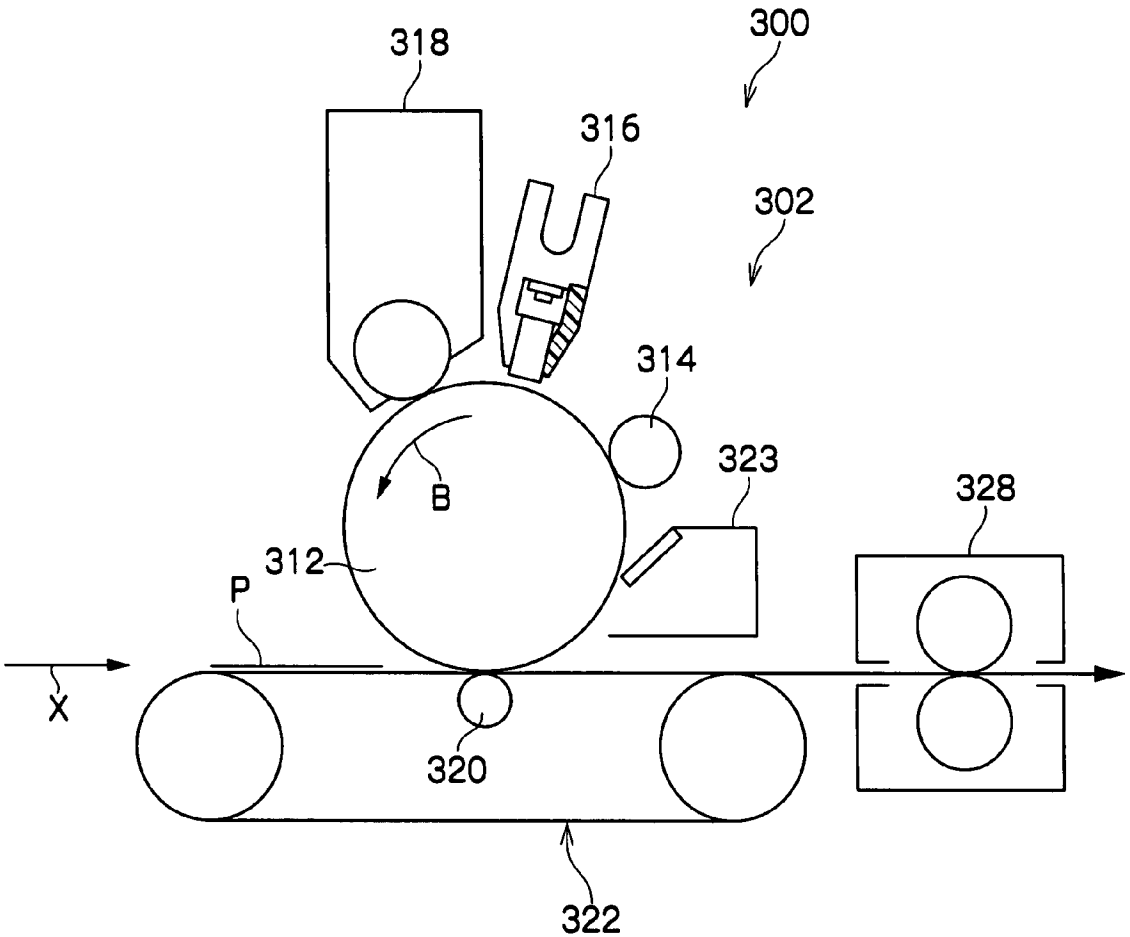
FIG. 22 is a diagram schematically showing an electrophotographic recording device relating to a third embodiment of the present invention.

As shown in FIG. 22, the recording device 300 has an electrophotographic recording section 302. The electrophotographic recording section 302 has a photoreceptor drum 312 which rotates at a uniform speed in the direction of arrow B. Note that the direction of rotation of the photoreceptor drum 312 (the direction of arrow B) corresponds to the sub-scanning direction.

A charger 314, an LED printer head 316, a developer 318, a transfer roller 320, a cleaner 323, and an erase lamp (not shown) are disposed in that order along the direction of rotation of the photoreceptor drum 312, at the periphery of the photoreceptor drum 312. Further, although not shown, the accommodating stocker described in the first embodiment is provided at the upstream side in FIG. 22, and the sheet discharge tray is provided at the downstream side.

After the surface of the photoreceptor drum 312 is charged uniformly by the charger 314, a light beam is illuminated thereon by the LED printer head 316, and a latent image is formed on the photoreceptor drum 312. The formed latent image is developed by the developer 318, such that a toner image is formed on the photoreceptor drum 312. Then, the toner image on the photoreceptor drum 312 is transferred by the transfer roller 320 onto the recording sheet P which is fed-out from the accommodating stocker (refer to the first embodiment) and is conveyed by a second conveying section 322.

The toner remaining on the photoreceptor drum 312 after transfer is removed by the cleaner 323, and charges are removed by the erase lamp. Thereafter, the surface of the photoreceptor drum 312 is again charged by the charger 314, and the same processings are repeated.

The recording sheet P, on which the toner image has been transferred, is conveyed to a fixing device 328, and the image is fixed thereon. The recording sheet P is then discharged out to the sheet discharge tray (refer to the first embodiment).

Figure 23:
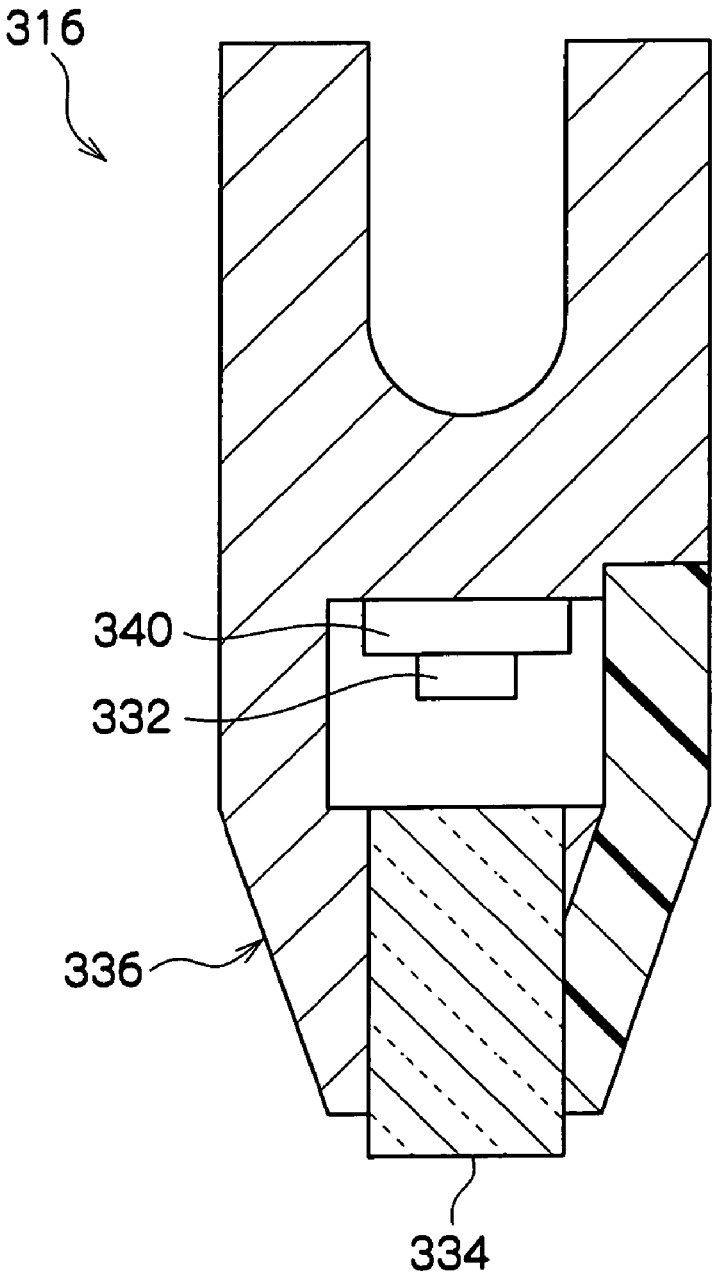
FIG. 23 is a cross-sectional view schematically showing an LED head of the electrophotographic recording device relating to the third embodiment of the present invention.
Figure 24:
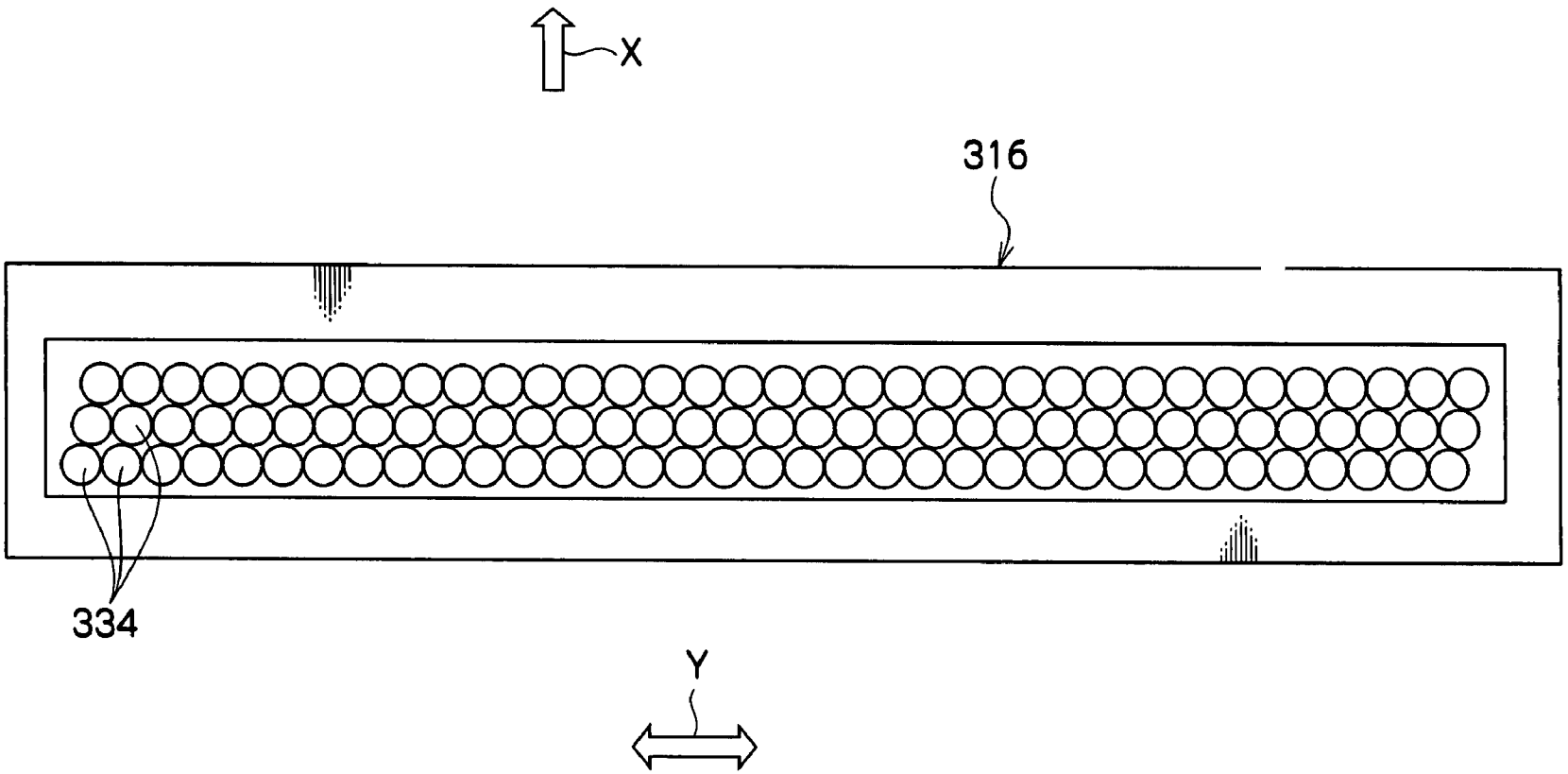
FIG. 24 is a bottom view schematically showing the LED head of the electrophotographic recording device relating to the third embodiment of the present invention.

As shown in FIGS. 23 and 24, the LED printer head 316 has an LED array 332, a housing 336, a printed board 340 on which are formed circuits for supplying various types of signals for controlling the driving of the LED array 332, and a Selfoc lens array 334 (Selfoc is a registered trademark of Nippon Sheet Glass Co., Ltd.) which images onto the photoreceptor drum 312 the light exiting from the LED array 332. The LED array 332 and the printed board 340 are mounted within the housing 336. Note that the widths in the Y direction of the photoreceptor drum 312 and the LED print head 316 are wider than the width of the recording sheet P1 in the Y direction.

At the electrophotographic recording device 300 as well, when only a partial region of the photoreceptor drum 312 is used concentratedly, only that portion deteriorates. Or, there are cases in which the photoreceptor drum 312 is scratched by the transverse direction edges of the recording sheets P2, P3. Further, only the portion of the LED array 332 which is used concentratedly deteriorates. Accordingly, in the same way as in the first embodiment, the relative positions, in the Y direction which is orthogonal to the conveying direction X, of the recording sheets P and the recording section 302 are changed so that use does not concentrate at only a partial region. Detailed description of the changing of the relative positions in the Y direction will be omitted as it would be redundant with that of the first embodiment.

A structure may be employed in which only the LED printer head 316 is moved in the Y direction which is orthogonal to the conveying direction X.

Further, a structure can be used in which the relative positions of the recording sheets P and the LED print head 316 in the Y direction are changed, rather than the relative positions of the recording sheets P and the recording section 302 in the Y direction.

Note that the present invention is not limited to the above-described embodiments. For example, the present invention can also be applied to other recording devices, such as a thermal transfer type recording device or the like.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

A first aspect of the present invention provides a recording device including: a recording section which records an image on a recording medium which is conveyed, wherein a recording region of the recording section is greater than or equal to a width of a recording medium which is a maximum width which can be recorded, and when recording a recording medium of a width which is narrower than the maximum width which can be recorded, relative positions of the recording section and the recording medium are changed in a direction orthogonal to a conveying direction of the recording medium.

In the above-described first aspect, the relative positions of the recording section and the recording medium can be changed in the direction orthogonal to the conveying direction of the recording medium.

When printing a recording medium of a width narrower than a recording medium of the maximum width which can be recorded, only the recording region portion of the recording section which corresponds to the width of the narrow recording medium is used, and the other recording region portion is not used. Accordingly, deterioration of only the recording region portion corresponding to the portion of the width of the narrow recording medium advances, and deterioration of the other portion does not advance. Therefore, at the entire recording region, a portion at which deterioration has advanced and a portion at which deterioration has not advanced arise. Namely, dispersion in the characteristics arises, and the printing quality level markedly deteriorates. Further, because the deterioration does not occur uniformly on average, the lifespan is shortened.

Thus, by changing the relative positions of the recording section and the recording medium in the direction orthogonal to the conveying direction of the recording medium so as to not concentratedly use only a portion of the recording region, dispersion in the characteristics can be suppressed, and a drop in the printing quality level can be prevented. Further, because members are used in a balanced manner, the lifespan can be lengthened.

Printing is carried out after the relative positions of the recording section and the recording medium are changed. Therefore, at the time of printing onto a single recording medium as in a shuttle method for example, there are the effects that there is no need to operate the recording section reciprocatingly in the conveying direction, batch printing is possible, and printing can be carried out without decreasing the printing speed.

In the first aspect, the recording section may have a liquid droplet ejecting head which is linear and which is disposed in the direction orthogonal to the conveying direction of the recording medium.

In accordance with the above-described structure, the linear liquid droplet ejecting head, which is disposed in the direction orthogonal to the conveying direction of the recording medium, is not used concentratedly at only a portion of the recording region. Therefore, dispersion in the characteristics of the overall recording region can be suppressed.

Note that the type of the liquid droplet ejecting head is not limited. For example, any of a piezoelectric element, a thermal element, an electrostatic element, or the like can be used as the element which ejects the liquid droplets.

In the above-described structure, the liquid droplet ejecting head may have plural liquid droplet ejecting units which are short, and replacement may be able to be carried out per liquid droplet ejecting unit.

In accordance with the above-described structure, because a liquid droplet ejecting unit which has deteriorated or a liquid droplet ejecting unit whose lifespan has ended can be replaced, dispersion in the characteristics can be further suppressed.

In the above-described structure, the relative positions may be changed in units of a width of the liquid droplet ejecting unit which is short.

In accordance with the above-described structure, because the relative positions are changed in units of the width of the liquid droplet ejecting unit which is short, the recording region which is used concentratedly is dispersed in units of the liquid droplet ejecting unit. Accordingly, this is suitable because the deterioration in the characteristics as well occurs in units of the liquid droplet ejecting unit.

In the first aspect, the recording section may have a dot impact recording head which is linear and which is disposed in the direction orthogonal to the conveying direction of the recording medium.

In accordance with the above-described structure, the linear dot impact recording head, which is disposed in the direction orthogonal to the conveying direction of the recording medium, is not used concentratedly at only a portion of the recording region. Therefore, dispersion in the characteristics of the overall recording region can be suppressed.

In the first aspect, the recording section may have an electrophotographic recording section which transfers a toner image, which is formed by developing an electrostatic latent image formed on a photoreceptor, onto the recording medium.

In accordance with the above-described structure, because it is not the case that only a portion of the photoreceptor is used concentratedly, dispersion in the characteristics of the photoreceptor can be suppressed.

In the first aspect, the relative positions may be changed by changing a position of the recording medium in the direction orthogonal to the conveying direction.

In accordance with the above-described structure, the position of the recording medium in the direction orthogonal to the conveying direction is changed, and the relative positions are changed. Therefore, the relative positions can be changed without the recording section being made to be large, and it is possible to prevent only a portion of the recording section from being used concentratedly.

In the above-described structure, the recording medium may be accommodated in a recording medium accommodating section, and the relative positions may be changed by changing, in the direction orthogonal to the conveying direction, the position of the recording medium within the recording medium accommodating section.

In accordance with the above-described structure, the position of the recording medium is changed in the direction orthogonal to the conveying direction within the recording medium accommodating section, and the relative positions are changed. Accordingly, the relative positions can be changed with a simple structure.

The relative positions may be changed by changing, in the direction orthogonal to the conveying direction, the position of the recording medium at a sheet feeding mechanism section at an upstream side of the recording section.

In accordance with the above-described structure, the relative positions are changed by changing the position of the recording medium in the direction orthogonal to the conveying direction at the sheet feeding mechanism section which is at the upstream side of the recording section. Accordingly, the relative positions can be changed regardless of the structure of the recording medium accommodating section for example.

A discharge position, at which the recording medium is discharged in a discharging section, may be moved in accordance with the position of the recording medium which is changed in the direction orthogonal to the conveying direction.

In accordance with the above-described structure, the discharge position, to which the recording medium is discharged, is moved in accordance with the position of the recording medium which is changed in the direction orthogonal to the conveying direction. Therefore, the recording medium can match at the discharging section.

In the first aspect, the relative positions may be changed by changing a position of the recording section in the direction orthogonal to the conveying direction.

In accordance with the above-described structure, the relative positions are changed due to the position of the recording section being changed in the direction orthogonal to the conveying direction. Accordingly, even in a case in which it is difficult to change the position of the recording medium for example, the relative position relationship is changed, and it is possible to prevent only a portion of the recording section from being used concentratedly. Note that a case in which it is difficult to change the position of the recording medium is, for example, the case of a recording device which uses a continuous sheet, or the like.

In the first aspect, the relative positions may be changed automatically at a predetermined time.

In accordance with the above-described structure, because the relative positions are changed automatically at a predetermined time, concentrated use of only a portion of the recording section can be reliably prevented.

In the above-described structure, the predetermined time may be a time when recording has been carried out continuously on a predetermined number of recording media which are narrower than the maximum width.

In accordance with the above-described structure, the relative positions are changed at the time when recording has been carried out continuously on a predetermined number of recording media which are narrower than the maximum width. Therefore, concentrated use of only a portion of the recording section can be reliably prevented.

The predetermined time may be a time when recording of a same image has been carried out continuously on a predetermined number of recording media.

In accordance with the above-described structure, the relative positions are changed when recording of the same image has been carried out continuously on a predetermined number of recording media. Therefore, concentrated use of only a portion of the recording section can be reliably prevented.

The predetermined time may be a time when recording has been carried out on a predetermined number of recording media.

In accordance with the above-described structure, the relative positions are changed when recording has been carried out onto a predetermined number of recording media. Therefore, concentrated use of only a portion of the recording section can be reliably prevented.

The predetermined time may be a time when a recorded amount which has been recorded onto recording media has reached a predetermined recorded amount.

In accordance with the above-described structure, the relative positions are changed when a recorded amount which has been recorded onto the recording media has reached a predetermined recorded amount. Therefore, concentrated use of only a portion of the recording section can be reliably prevented.

The predetermined time may be a time when a predetermined time period has elapsed from a start of recording.

In accordance with the above-described structure, the relative positions are changed when a predetermined time period has elapsed from the start of recording. Therefore, concentrated use of only a portion of the recording section can be reliably prevented.

The first aspect may be structured such that plural recording media, whose widths are narrower than the maximum width which can be recorded, may be conveyed simultaneously in parallel, and images may be recorded simultaneously onto the plural recording media.

In accordance with the above-described structure, plural recording media of narrow widths can be conveyed simultaneously in parallel, and images can be recorded simultaneously onto the plural recording media. Therefore, concentrated use of only a portion of the recording section can be reliably prevented, and the recording speed can be improved.

A second aspect of the present invention provides a recording method recording an image onto a recording medium, which is conveyed, of a recording device having a recording section, a recording region of the recording section being greater than or equal to a maximum width which can be recorded, the method including: when recording a recording medium which is narrower than the maximum width which can be recorded, changing relative positions of the recording section and the recording medium in a direction orthogonal to a conveying direction of the recording medium.

As described above, in accordance with the present invention, the concentrated use of only a portion of a recording section can be prevented. Therefore, deterioration in the characteristics of the recording region, breakage, dispersion, a lowering of the printing quality level, and the like can be suppressed. Further, because printing is carried out on the recording medium after the relative positions of the recording section and the recording medium are changed, there is no need to reciprocatingly convey the recording section plural times between recording media at the time of recording onto recording media, and batch printing, which does not lower the printing speed, is possible.

What is claimed is:

1. A recording device comprising:

a recording section which records an image on a recording medium which is conveyed, wherein a recording region of the recording section is greater than or equal to a width of a recording medium which is a maximum width which can be recorded, and when recording a recording medium of a width which is narrower than the maximum width which can be recorded, relative positions of the recording section and the recording medium are changed in a direction orthogonal to a conveying direction of the recording medium.

2. The recording device of claim 1, wherein the recording section has a liquid droplet ejecting head which is linear and which is disposed in the direction orthogonal to the conveying direction of the recording medium.

3. The recording device of claim 2, wherein the liquid droplet ejecting head has a plurality of liquid droplet ejecting units that each have a width that is smaller than the width of the recording region of the recording section, and each liquid droplet ejecting unit is individually replaceable.

4. The recording device of claim 3, wherein the relative positions are changed in units of a width of the liquid droplet ejecting unit.

5. The recording device of claim 1, wherein the recording section has a dot impact recording head which is linear and which is disposed in the direction orthogonal to the conveying direction of the recording medium.

6. The recording device of claim 1, wherein the recording section has an electrophotographic recording section which transfers a toner image, which is formed by developing an electrostatic latent image formed on a photoreceptor, onto the recording medium.

7. The recording device of claim 1, wherein the relative positions are changed by changing a position of the recording medium in the direction orthogonal to the conveying direction.

8. The recording device of claim 7, further comprising a recording medium accommodating section, wherein the recording medium accommodating section accommodates the recording medium, and the relative positions are changed by changing, in the direction orthogonal to the conveying direction, the position of the recording medium within the recording medium accommodating section.

9. The recording device of claim 7, further comprising a discharging section, wherein a discharge position, at which the recording medium is discharged in the discharging section, is moved in accordance with the position of the recording medium which is changed in the direction orthogonal to the conveying direction.

10. The recording device of claim 1, wherein the relative positions are changed by changing a position of the recording section in the direction orthogonal to the conveying direction.

11. A recording method recording an image onto a recording medium, which is conveyed, of a recording device having a recording section, a recording region of the recording section being greater than or equal to a maximum width which can be recorded, the method comprising:

when recording a recording medium which is narrower than the maximum width which can be recorded, changing relative positions of the recording section and the recording medium in a direction orthogonal to a conveying direction of the recording medium.

12. A recording device comprising:

a recording section recording an image onto a recording medium which is conveyed, a recording region of the recording section being greater than or equal to a width of a recording medium of a maximum width which can be recorded; and a changing mechanism which, when recording a recording medium of a width narrower than the maximum width which can be recorded, changes, in a direction orthogonal to a conveying direction of the recording medium, relative positions of the recording section and the recording medium, by changing a position of the recording medium.

* * * * *